US009559400B2

(12) United States Patent
Kroening

(10) Patent No.: US 9,559,400 B2
(45) Date of Patent: Jan. 31, 2017

(54) WAVEGUIDE CIRCULATOR WITH IMPROVED TRANSITION TO OTHER TRANSMISSION LINE MEDIA

(71) Applicant: Honeywell International Inc., Morris Plains, NJ (US)

(72) Inventor: Adam M. Kroening, Atlanta, GA (US)

(73) Assignee: Honeywell International Inc., Morris Plains, NJ (US)

( * ) Notice: Subject to any disclaimer, the term of this patent is extended or adjusted under 35 U.S.C. 154(b) by 0 days.

(21) Appl. No.: 14/964,152

(22) Filed: Dec. 9, 2015

(65) Prior Publication Data

US 2016/0087324 A1 Mar. 24, 2016

Related U.S. Application Data

(62) Division of application No. 13/848,242, filed on Mar. 21, 2013, now Pat. No. 9,270,000.

(51) Int. Cl.
*H01P 1/39* (2006.01)
*H01P 1/387* (2006.01)
(Continued)

(52) U.S. Cl.
CPC ..... *H01P 1/387* (2013.01); *H01P 1/383* (2013.01); *H01P 1/39* (2013.01); *H01P 5/103* (2013.01)

(58) Field of Classification Search
CPC ..... H01P 1/39; H01P 1/38; H01P 1/383
(Continued)

(56) References Cited

U.S. PATENT DOCUMENTS 4,697,158 A 9/1987 Hoover et al.
4,801,902 A 1/1989 Hoover et al.
(Continued)

FOREIGN PATENT DOCUMENTS

JP 2000232305 8/2000
KR 20020065662 8/2002
WO 03041213 5/2003

OTHER PUBLICATIONS

European Patent Office, "Office Action from EP Application No. 14160372.0 mailed Sep. 5, 2014", "from Foreign counterpart of U.S. Appl. No. 13/848,242", Sep. 5, 2014, pp. 1-8, Published in: EP.
(Continued)

*Primary Examiner* — Stephen E Jones
(74) *Attorney, Agent, or Firm* — Fogg & Powers LLC

(57) ABSTRACT

A waveguide circulator for an electro-magnetic field having a wavelength is provided. The waveguide circulator includes: N waveguide arms, where N is a positive integer; a ferrite element having N segments protruding into the N respective waveguide arms; at most (N−1) quarter-wave dielectric transformers attached to respective ends of at most (N−1) other segments; a first quarter-wave dielectric transformer attached to an end of the first segment; and a coaxial-coupling component. The N waveguide arms include a first-waveguide arm and (N−1) other-waveguide arms. The N segments include a first segment protruding into the first-waveguide arm and (N−1) other segments protruding into respective (N−1) other-waveguide arms. The coaxial-coupling component is positioned within a quarter wavelength of the electro-magnetic field from the first quarter-wave dielectric transformer positioned in the first-waveguide arm.

11 Claims, 19 Drawing Sheets

(51) Int. Cl.
*H01P 1/383* (2006.01)
*H01P 5/103* (2006.01)

(58) Field of Classification Search
USPC ..... 333/1.1, 24.2
See application file for complete search history.

(56) References Cited

U.S. PATENT DOCUMENTS

| | | | | |
|---|---|---|---|---|
| 5,266,909 | A | 11/1993 | Wolfert | |
| 5,608,361 | A | 3/1997 | Weiss et al. | |
| 6,144,267 | A * | 11/2000 | Saitoh | H01P 5/087 333/1.1 |
| 6,885,257 | B2 | 4/2005 | Kroening | |
| 7,049,900 | B2 | 5/2006 | Kroening | |
| 7,176,767 | B2 | 2/2007 | Kroening | |
| 7,230,507 | B2 | 6/2007 | Kroening | |
| 7,242,263 | B2 | 7/2007 | Kroening | |
| 7,561,003 | B2 | 7/2009 | Kroening | |
| 7,746,189 | B2 | 6/2010 | Hocine et al. | |
| 8,217,730 | B1 | 7/2012 | Catoiu | |
| 2005/0184833 | A1 | 8/2005 | Higgins et al. | |
| 2006/0232353 | A1 | 10/2006 | Kroeing | |
| 2007/0139131 | A1 | 6/2007 | Kroening | |
| 2009/0108953 | A1 | 4/2009 | Kroening | |

OTHER PUBLICATIONS

European Patent Office, "European Search Report from EP Application No. 14160372.0 mailed Jul. 25, 2014", "from Foreign Counterpart of U.S. Appl. No. 13/848,242", Jul. 25, 2014, pp. 1-4, Published in: EP.

U.S. Patent and Trademark Office, "Final Office Action", "from U.S. Appl. No. 13/848,242", Aug. 4, 2015, pp. 1-6, Published in: US.

U.S. Patent and Trademark Office, "Notice of Allowance", "from U.S. Appl. No. 13/848,242", Oct. 27, 2015, pp. 1-7, Published in: US.

U.S. Patent and Trademark Office, "Office Action", "from U.S. Appl. No. 13/848,242", Feb. 5, 2015, pp. 1-18, Published in: US.

U.S. Patent and Trademark Office, "Restriction Requirement", "from U.S. Appl. No. 13/848,242", Jan. 2, 2015, pp. 1-5, Published in: US.

Edwards, "Microstrip Circuits", "Encyclopedia of RF and Microwave Engineering, vol. 1-6, At least as early as Dec. 2005", 2005, pp. 1-67.

Schieblich et al., "Circulators in Below-Cutoff Waveguides", "Archiv Fa 1/4 R Elektronik Und Ubertragungstechnik", Jan. 1, 1983, pp. 50-55, vol. 37, No. 1/2.

* cited by examiner

WAVEGUIDE CIRCULATOR WITH IMPROVED TRANSITION TO OTHER TRANSMISSION LINE MEDIA

This application is a divisional of U.S. application Ser. No. 13/848,242 entitled "WAVEGUIDE CIRCULATOR WITH IMPROVED TRANSITION TO OTHER TRANSMISSION LINE MEDIA" and filed on Mar. 21, 2013, the disclosure of which is incorporated herein by reference.

BACKGROUND

Circulators have a wide variety of uses in commercial, military, space, terrestrial, and low power applications, and high power applications. A waveguide circulator may be implemented in a variety of applications, including, but not limited to, low noise amplifier (LNA) redundancy switches, T/R modules, isolators for high power sources, and switch matrices Such waveguide circulators are important in space applications (for example, in satellites) where reliability is essential and where reducing size and weight is important.

Moving parts wear down over time and have a negative impact on long term reliability. Circulators made from a ferrite material have high reliability due to their lack of moving parts. Thus, the highly reliable ferrite circulators are desirable for space applications.

Waveguides may be the best electro-magnetic transmission media for the circulator in order to provide low insertion loss or to allow for a switchable direction of circulation. However, the waveguide circulator may need to directly interface to components in other transmission media, such as coaxial or microstrip line. An example of one such component is an LNA. LNAs are implemented on microstrip transmission line, and may have microstrip or coaxial interfaces. Therefore, a transition from a waveguide to a microstrip or to a coaxial line is required between the waveguide circulator and each LNA.

SUMMARY

The present application relates to a waveguide circulator for an electro-magnetic field having a wavelength. The waveguide circulator includes: N waveguide arms, where N is a positive integer; a ferrite element having N segments protruding into the N respective waveguide arms; at most (N−1) quarter-wave dielectric transformers attached to respective ends of at most (N−1) other segments; a first quarter-wave dielectric transformer attached to an end of the first segment; and a coaxial-coupling component. The N waveguide arms include a first-waveguide arm and (N−1) other-waveguide arms. The N segments include a first segment protruding into the first-waveguide arm and (N−1) other segments protruding into respective (N−1) other-waveguide arms. The coaxial-coupling component is positioned within a quarter wavelength of the electro-magnetic field from the first quarter-wave dielectric transformer positioned in the first-waveguide arm.

DRAWINGS

Understanding that the drawings depict only exemplary embodiments and are not therefore to be considered limiting in scope, the exemplary embodiments will be described with additional specificity and detail through the use of the accompanying drawings, in which.

In accordance with common practice, the various described features are not drawn to scale but are drawn to emphasize features relevant to the present invention. Like reference characters denote like elements throughout figures and text.

DETAILED DESCRIPTION

Figure 1:
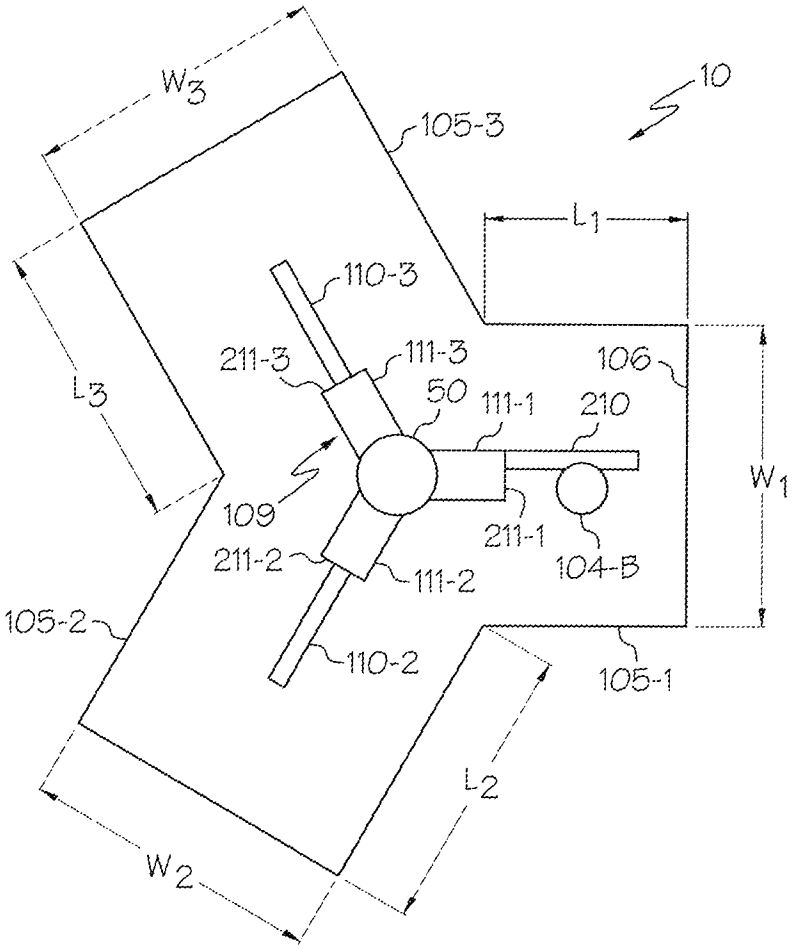
FIGS. 1 and 2 are block diagrams illustrating top and oblique views, respectively, of a waveguide circulator according to one embodiment.

In the following detailed description, reference is made to the accompanying drawings that form a part hereof, and in which is shown by way of illustration specific illustrative embodiments in which the invention may be practiced. These embodiments are described in sufficient detail to enable those skilled in the art to practice the invention, and it is to be understood that other embodiments may be utilized and that logical, mechanical and electrical changes may be made without departing from the scope of the present invention. The following detailed description is, therefore, not to be taken in a limiting sense.

The waveguide circulators described herein improve upon the currently available waveguide circulators by eliminating the empty-waveguide transition between a waveguide circulator and a coaxial or microstrip device. The coupling of the electro-magnetic radiation (e.g., a radio frequency (RF) signal or a microwave signal) thus occurs in a shortened space and the length of at least one waveguide arm in the waveguide circulator is reduced from the length of the input (or output) waveguide arm of prior art waveguide circulators. The embodiments of waveguide circulators described herein include impedance matching chains that include one of: 1) ferrite-element to quarter-wave ($\lambda/4$)-dielectric-transformer to coaxial-probe; or 2) ferrite-element to integrated-transition element that includes a microstrip-dielectric board attached to an end of the a segment of the ferrite element, a microstrip trace, and a microstrip-ground layer.

In embodiments in which the transition from a ferrite element is made via a coaxial probe, the coaxial probe is co-located in the region occupied by the λ/4-dielectric transformer and the empty-waveguide-transition region is eliminated. In prior art waveguide circulators, the coaxial probe is in the empty-waveguide-transition region. Thus, in the embodiments of waveguide circulators described in this document, the impedance matching chain, in the direction of RF propagation, is reduced by the elimination of the empty-waveguide interface.

The waveguide circulators described herein include a single-ferrite switch or a ferrite-triad switch. In one implementation of this embodiment, the waveguide circulator has a coaxial connector interface instead of a waveguide interface.

A waveguide circulator with a coaxial probe co-located in the region of the λ/4-dielectric transformer is designed and validated using software modeling as follows. First, a standalone ferrite circulator is designed using standard methods. Second, a coaxial probe and backshort are introduced and the performance is optimized by repositioning the coaxial probe and the backshort. Third, the λ/4-dielectric transformer in the same region as the probe is re-optimized in terms of size, material, and/or positioning. In one implementation of this embodiment, the same transformer used when matching to an empty-waveguide interface provides optimal performance, but is moved off-center with respect to the waveguide broadwall to avoid interference with the coaxial probe.

In some embodiments of the waveguide circulators described in this document, the transition from a ferrite element is made by replacing the λ/4-dielectric transformer with an integrated transformer/microstrip launch (also referred to herein as an integrated-transition element) that functions simultaneously as a transformer and a microstrip probe to optimize impedance matching in the waveguide arm. In the direction of RF propagation, the impedance matching chain from ferrite element is reduced. In one implementation of this embodiment, the waveguide circulator has a microstrip interface instead of a waveguide interface.

A waveguide circulator with an integrated transformer/microstrip launch replacing the λ/4-dielectric transformer is designed and validated using software modeling as follows. First, a standalone ferrite circulator is designed using standard methods. Second, the λ/4-dielectric transformer is replaced with an RF microstrip board. Third, the return loss performance is optimized by: positioning of a current loop trace on the RF microstrip board; the position of an edge of a microstrip ground plane on the RF microstrip board; a width of the waveguide in the microstrip section; a thickness of the dielectric material of the RF microstrip board; and positioning of the dielectric material of the RF microstrip board. Standard RF board dielectrics and the dielectric constant of the RF board material can be optimized in addition to the dimensions referred to above.

The waveguide circulators described herein provide a shorter transition path length with a resultant reduction in the size, mass, and insertion loss of a transition from a waveguide ferrite circulator switch to a coaxial connector or to a microstrip. The waveguide circulators described herein improve the frequency bandwidth that is coupled in the transition region by eliminating the highest impedance section (i.e., the empty-waveguide interface) of the transition region. The transition to the coaxial impedance (e.g., 50 ohms) is closer to the ferrite-filled low impedance section of the waveguide circulator. Embodiments of the waveguide circulators described herein are appropriate for coupling to redundant low noise amplifiers (RLNAs) in order to improve the system noise figure by reducing the path length and number of transitions required between the waveguide redundancy switches and the microstrip-based LNAs. In one implementation of this embodiment, the waveguide circulators described herein are coupled to redundant low noise amplifiers in the Ka-band.

The waveguide circulators described herein are useful in any applications that require transitions between waveguide circulators and components using other RF transmission media, such as a coaxial-coupling component or a microstrip line. Some exemplary applications include: a switch triad assembly comprised of one switching circulator and two switching or non-switching isolators, a dual redundant LNA assembly comprised of two switch triads and two LNA's, and an "i"-to-"j" switch matrix with the number of circulators dependent on the values of "i" and "j".

Figure 2:
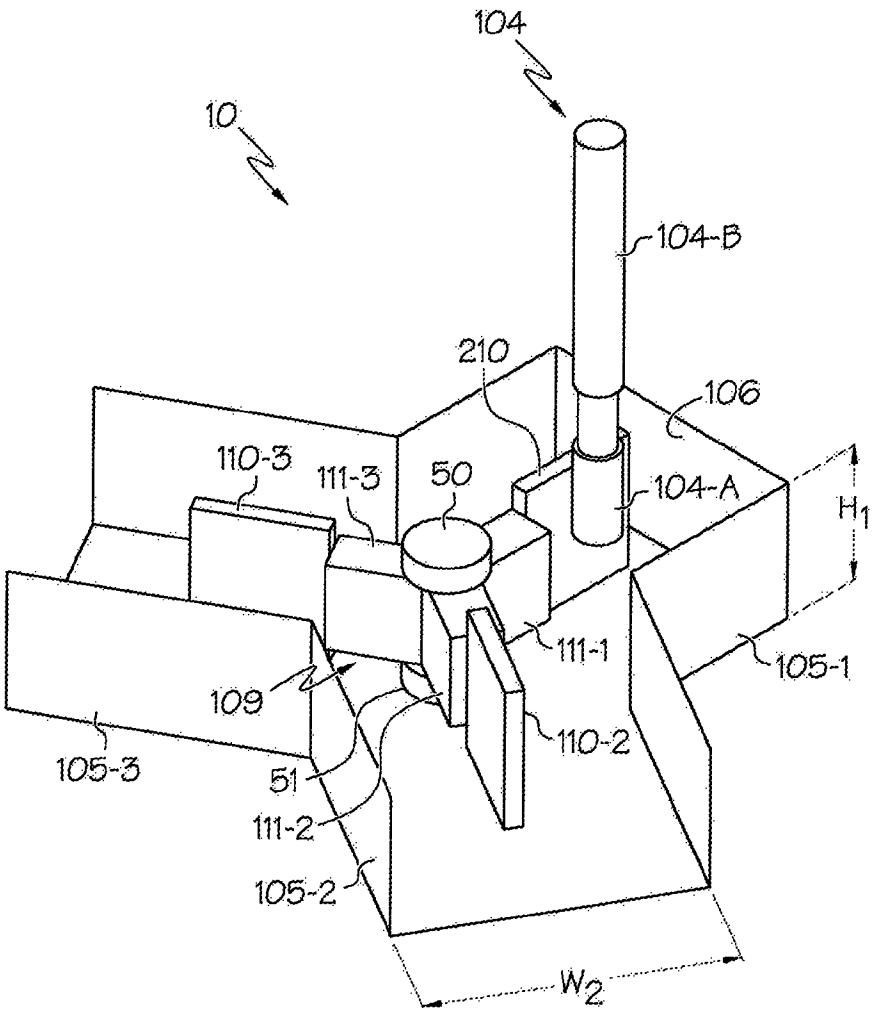

FIGS. 1 and 2 are block diagrams illustrating top and oblique views, respectively, of a waveguide circulator 10 according to one embodiment. The waveguide circulator 10 circulates an electro-magnetic field from an input waveguide to an output waveguide. The electro-magnetic field being circulated by the waveguide circulator 10 is one of a microwave signal or an RF signal at a specific wavelength λ. As shown in FIG. 1, the waveguide circulator 10 includes three waveguide arms 105(1-3), a ferrite element 109, three quarter-wave dielectric transformers 210, 110-2 and 110-3, and a coaxial-coupling component 104.

The three waveguide arms 105(1-3) include a first-waveguide arm 105-1 and two other-waveguide arms 105-2 and 105-3. In one implementation of this embodiment, the waveguide circulator 10 includes N waveguide arms 105(1-N) including a first-waveguide arm 105-1 and N−1 other-waveguide arms 105(2-N). N is a positive integer.

The ferrite element 109 has three segments 111(1-3) protruding into the three respective waveguide arms 105(1-3), respectively. Specifically, the ferrite element 109 has a first segment 111-1 protruding into the first-waveguide arm 105-1, and two other segments 111(2-3) protruding into respective other-waveguide arms 105(2-3). The two other segments 111(2-3) are also referred to herein as second segment 111-2 and third segment 111-3. The other-waveguide arms 105(2-3) are also referred to herein as second-waveguide arm 105-2 and third-waveguide arm 105-3.

The first-waveguide arm 105-1 has a length $L_1$, a width $W_1$, and a height $H_1$. The second-waveguide arm 105-2 has a length $L_2$, a width $W_2$, and the height $H_1$. The third-waveguide arm 105-3 has a length $L_3$, a width $W_3$, and the height $H_1$. As shown in FIG. 2, the first-waveguide arm 105-1 is terminated with a backshort 106 (i.e., with a waveguide wall 106). The length $L_1$ of the first-waveguide arm 105-1 is optimized to maximize the transfer of energy from the waveguide to the coaxial probe (i.e., the coaxial-coupling component 104). In one implementation of this embodiment, the backshort 106 is about λ/4 from the coaxial-coupling component 104.

As shown in FIG. 2, the second-waveguide arm 105-2 and the third-waveguide arm 105-3 are not terminated with a waveguide backshort. The length $L_2$ of the second-waveguide arm 105-2 can be any length needed to encompass the second segment 111-2 and the second quarter-wave dielectric transformer 110-2. Likewise, the length $L_3$ of the third-waveguide arm 105-3 can be any length needed to encompass the third segment 111-3 and the third quarter-wave dielectric transformer 110-3. In one implementation of this embodiment, the length $L_1$ of the first-waveguide arm 105-1 is approximately the length $L_2$ of the first other-waveguide arm 105-2 and the length $L_3$ of the second other-waveguide arm 105-3. In one implementation of this embodiment, the first width $W_1$ is about equal to the second width $W_2$ and the third width $W_3$. In another implementation of this embodiment, the first height $H_1$ of the first waveguide arm 105-1 does not equal the height of the second-waveguide arm 105-2 and/or the third-waveguide arm 105-3. In yet another implementation of this embodiment, the width of the waveguides 105(1-3) is tapered and becomes narrower closer to the center of the ferrite element 109.

In one implementation of this embodiment, the ferrite element 109 having N segments 111(1-N) protruding into the N respective waveguide arms, the N segments 111(1-N) including: a first segment 111-1 protruding into the first-waveguide arm 105-1, and (N−1) other segments 111(2-N) protruding into respective (N−1) other-waveguide arms 105 (2-N).

The first quarter-wave dielectric transformer 210 is attached to an end 211-1 of the first segment 111-1 and extends into the first-waveguide arm 105-1. A second quarter-wave dielectric transformer 110-2 is attached to an end 211-2 of the other segment 111-2. The other segment 111-2 is also referred to herein as a second segment 111-2. A third quarter-wave dielectric transformer 110-3 is attached to an end 211-3 of the other segment 111-3. The other segment 111-3 is also referred to herein as a third segment 111-3. In embodiments in which there are N segments, where N>3, additional quarter-wave dielectric transformers 110(4-N) are attached to respective ends 211(4-N) of the other segments 111-(4-N).

The coaxial-coupling component 104 is positioned within a quarter wavelength λ/4 of the electro-magnetic field from the first quarter-wave dielectric transformer 210 positioned in the first-waveguide arm 105-1. As shown in FIG. 2, an external section 104-B of the coaxial-coupling component 104 is outside of the first waveguide 105-1 and the internal section 104-A of the coaxial-coupling component 104 is inside of the first waveguide 105-1. The external section 104-B of the coaxial-coupling component 104 represents the coaxial center conductor of a standard coaxial transmission line, such as a 50 ohm line, and the outer conductor of the coaxial one is not shown for clarity. The internal section 104-A of the coaxial-coupling component 104 is within a quarter wavelength λ/4 of the electro-magnetic field from the first quarter-wave dielectric transformer 210. As shown in FIG. 2, the internal section 104-A of the coaxial-coupling component 104 is in contact with the first quarter-wave dielectric transformer 210. In prior art waveguide circulators, the coaxial-coupling component is positioned away from the quarter-wave dielectric transformer by a distance much greater than a quarter wavelength λ/4 of the electro-magnetic field being circulated by the waveguide circulators. Typically, in prior art waveguide circulators, the coaxial-coupling component is positioned in the empty-waveguide interface which is between the opening of the waveguide arm and the end of the quarter-wave dielectric transformer that is not attached to the segment of the ferrite element.

Figure 3:
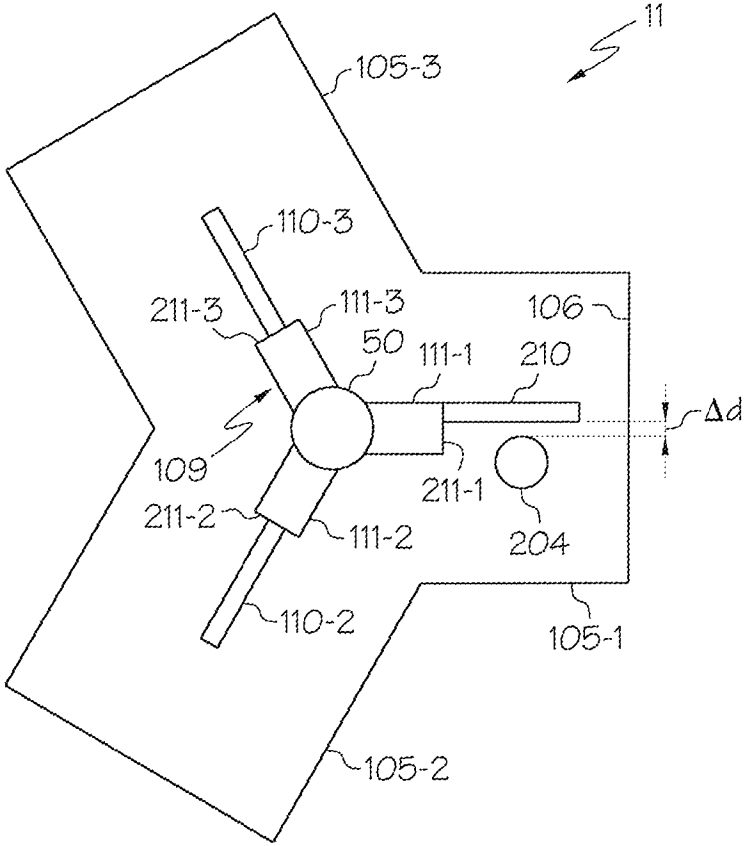
FIGS. 3 and 4 are block diagrams illustrating top views of waveguide circulators according to two embodiments.
Figure 4:
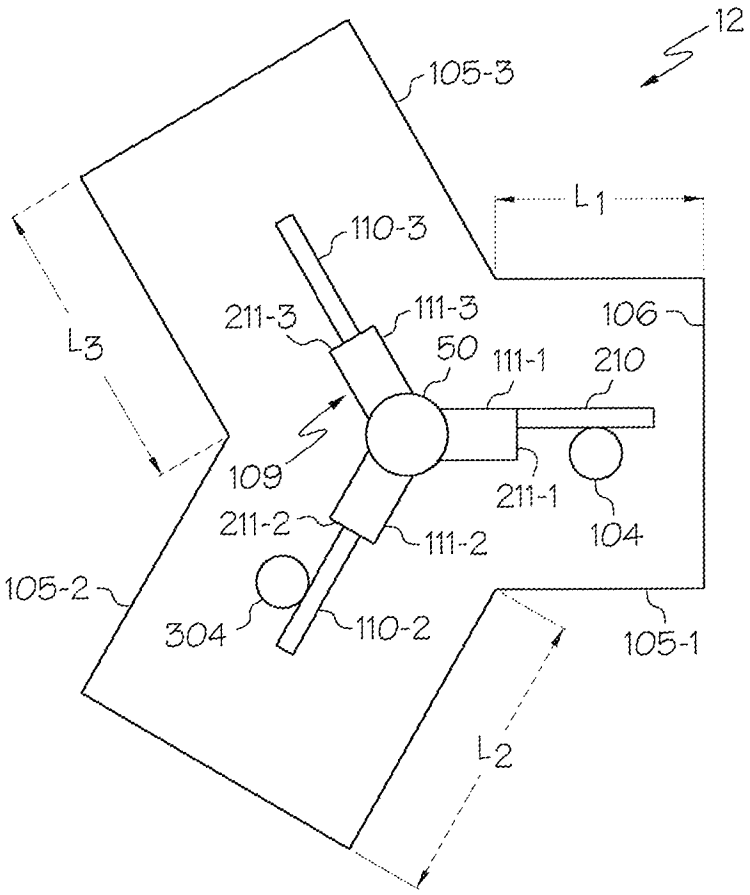

FIGS. 3 and 4 are block diagrams illustrating top views of waveguide circulators 11 and 12, respectively, according to two embodiments. The waveguide circulator 11 of FIG. 3 differs from the waveguide circulator 10 of FIGS. 1 and 2 in that the coaxial-coupling component 204 is not in contact with the first quarter-wave dielectric transformer 210. As shown in FIG. 3, the coaxial-coupling component 204 is separated from the first quarter-wave dielectric transformer 210 by a distance Δd that is less than a quarter wavelength λ/4 of the electro-magnetic field being circulated by the waveguide circulator 11.

The waveguide circulator 12 of FIG. 4 differs from the waveguide circulator 10 of FIGS. 1 and 2 in that there are two coaxial-coupling components 104. A first coaxial-coupling component 104 is positioned in the first-waveguide 105-1 and a second coaxial-coupling component 304 is positioned in the second-waveguide arm 105-2. As shown in FIG. 4, the coaxial-coupling component 104 is in contact with the first quarter-wave dielectric transformer 210 and the coaxial-coupling component 304 is in contact with the second quarter-wave dielectric transformer 110-2. The length $L_2$ of the second-waveguide arm 105-2 is approximately the length $L_1$ of the first-waveguide arm 105-1 and the length $L_3$ of the third-waveguide arm 105-3.

In one implementation of this embodiment, the coaxial-coupling component 104-A is in contact with the first quarter-wave dielectric transformer 210 and the coaxial-coupling component 304-A is not in contact with the second quarter-wave dielectric transformer 110-2. In this latter case, the coaxial-coupling component 304-A is positioned within the quarter wavelength of the electro-magnetic field from the second quarter-wave dielectric transformer 110-2.

In yet another implementation of this embodiment, the coaxial-coupling component 104-A is not in contact with the first quarter-wave dielectric transformer 210 and the coaxial-coupling component 304-A is in contact with the second quarter-wave dielectric transformer 110-2. In this latter case, the coaxial-coupling component 104-A is positioned within the quarter wavelength of the electro-magnetic field from the first quarter-wave dielectric transformer 210.

In yet another implementation of this embodiment, the coaxial-coupling component 104-A is not in contact with the first quarter-wave dielectric transformer 210 and the coaxial-coupling component 304-A is not in contact with the second quarter-wave dielectric transformer 110-2. In this latter case, the coaxial-coupling component 104-A is positioned within the quarter wavelength of the electro-magnetic field from the first quarter-wave dielectric transformer 210 and the coaxial-coupling component 304-A is positioned within the quarter wavelength of the electro-magnetic field from the second quarter-wave dielectric transformer 110-2.

In one implementation of embodiments of the waveguide circulators 10, 11, and 12, the first-waveguide arm 105-1 is an output-waveguide arm and the second-waveguide arm 105-2 is an input-waveguide arm. In another implementation of embodiments of the waveguide circulators 10, 11, and 12, the first-waveguide arm 105-1 is the input-waveguide arm 105-1 and the second-waveguide arm 105-2 is the output-waveguide arm 105-2. In yet another implementation of embodiments of the waveguide circulators 10, 11, and 12, at any given time: 1) the first-waveguide arm 105-1 is an output-waveguide arm and one of the (N−1) other-waveguide arms 105(2-N) is an input-waveguide arm; or 2) the first-waveguide arm 105-1 is the output-waveguide arm and the one of the (N−1) other-waveguide arms 105(2-N) is the output-waveguide arm. In yet another implementation of embodiments of the waveguide circulators 10, 11, and 12, the first-waveguide arm 105-1 is alternately an output-waveguide arm and an input-waveguide arm. In yet another implementation of embodiments of the waveguide circulators 10, 11, and 12, the second-waveguide arm 105-2 is alternately an output-waveguide arm and an input-waveguide arm.

The ferrite element 109 can be other shapes as well, such as a triangular puck, a cylinder, and the like. In at least one implementation, ferrite element 109 is a switchable or latchable ferrite circulator as opposed to a fixed bias ferrite circulator. A latchable ferrite circulator is a circulator where the direction of circulation can be latched in a certain direction. To make ferrite element 109 switchable, a magnetizing winding is threaded through apertures in the segments 111(1-N) of ferrite element 109 that protrude into the separate waveguide arms 105(1-3). Currents passed through a magnetizing winding control and establish a magnetic field in ferrite element 109. The polarity of magnetic field can be switched by the application of current on magnetizing winding to create a switchable circulator. The portion of ferrite element 109 where the segments 111 of the ferrite element 109 converge is referred to as a resonant section of ferrite element 109. The dimensions of the resonant section determine the operating frequency for circulation in accordance with conventional design and theory. The three protruding segments 111(1-3) of ferrite element 109 act both as return paths for the bias fields in resonant section and as impedance transformers out of resonant section.

The quarter-wave dielectric transformers 210, 110-1, and 110-2 shown in FIGS. 1-4 aid in the transition from a ferrite element 109 to a respective air-filled waveguide arm 105 (1-3) and the coaxial-coupling component 104. The quarter-wave dielectric transformers 210, 110-1, and 110-2 match the lower impedance of the ferrite element 109 to that of air-filled waveguide arms 105(1-3) and the coaxial-coupling component 104. The material used to fabricate ferrite element 109 is selected to have a particular saturation magnetization value, such that the impedance of ferrite element 109 matches the impedance of the quarter-wave dielectric transformers 210, 110-1, and 110-2.

In further embodiments, a dielectric spacer 50 is disposed on a surface of ferrite element 109 that is parallel to the H-plane. The dielectric spacer 50 is used to securely position ferrite element 109 in the housing and to provide a thermal path out of ferrite element 109 for high power applications. In some embodiments, a second dielectric spacer 51 (FIG. 2) is located on a surface of the ferrite element 109 that is opposite to the surface of ferrite element 109 in contact with dielectric spacer 50. The components described above are disposed within conductive waveguide circulator 10, 11, or 12.

Magnetic fields created in ferrite element 109 can be used to change the direction of propagation of an electro-magnetic field (e.g., a microwave signal or an RF signal). The electro-magnetic field can change from propagating in one waveguide arm 105 to propagating in another-waveguide arm 105 connected to the waveguide circulator 10, 11, or 12. A reversing of the direction of the magnetic field reverses the direction of circulation within ferrite element 109. The reversing of the direction of circulation within ferrite element 109 also switches which waveguide arm 105 propagates the signal away from ferrite element 109.

In at least one exemplary embodiment, a waveguide circulator 10, 11, or 12 is connected to three waveguide arms 105(1-3), where one of waveguide arms 105-1, 105-2, or 105-3 functions as an input arm and two other waveguide arms 105-1, 105-2, or 105-3 function as output arms. The input waveguide arm 105 propagates the electro-magnetic field into waveguide circulator 10, 11, or 12 and the waveguide circulator 10, 11, or 12 circulates electro-magnetic field through ferrite element 109 and out one of the two output waveguide arms. When the magnetic fields are changed, a microwave signal or an RF signal is circulated through ferrite element 109 and out of one of the two output waveguide arms 105-1, 105-2, or 105-3. Thus, a ferrite element 109 has a selectable direction of circulation. A microwave signal or an RF signal received from an input waveguide arm 105-1, 105-2, or 105-3 can be routed with a low insertion loss from the one waveguide arm 105-1, 105-2, or 105-3 to either of the other output waveguide arms 105-1, 105-2, or 105-3.

As shown, the ferrite element 109 is a Y-shaped ferrite element 109. Other shapes are possible.

Figure 5:
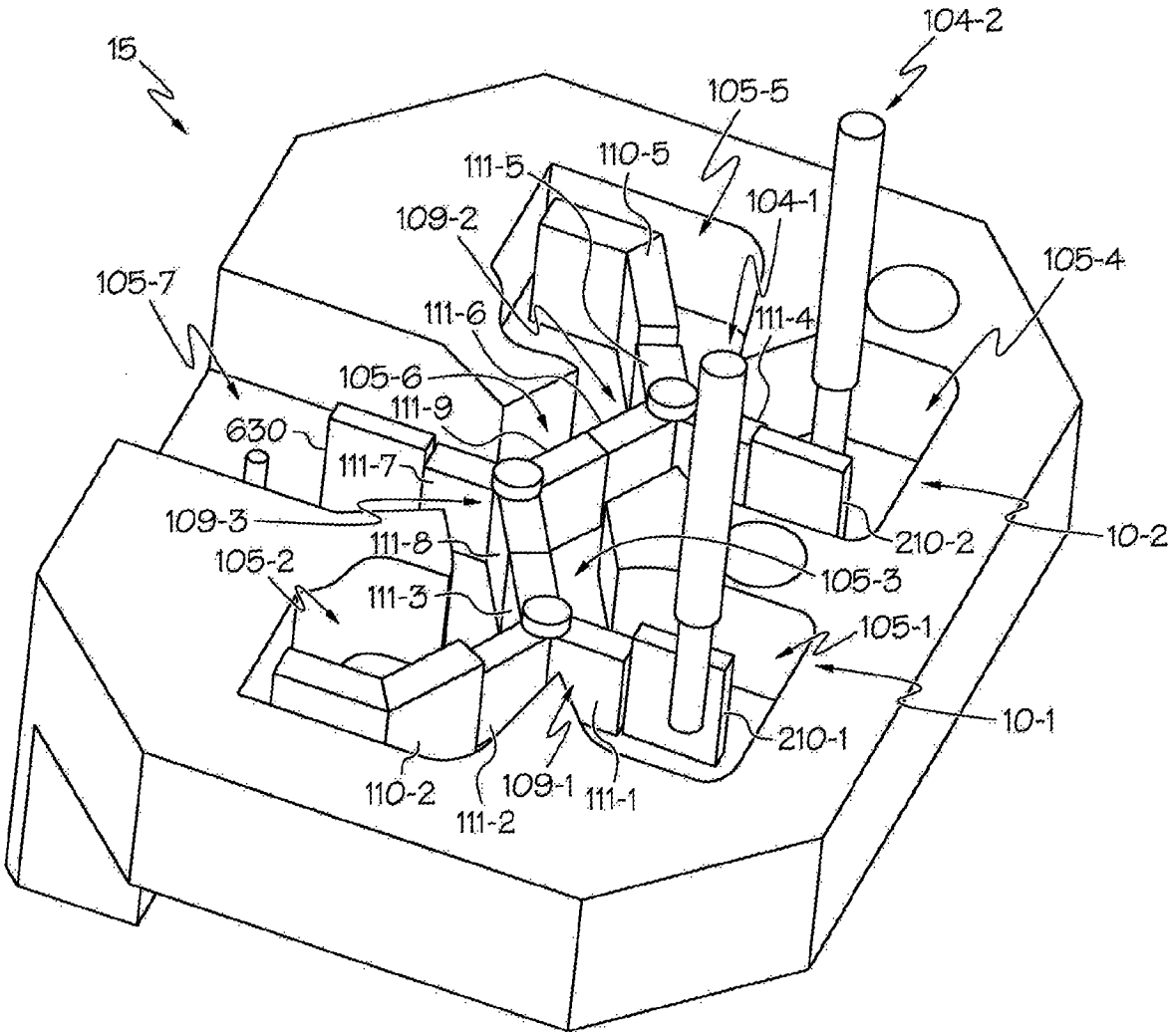
FIG. 5 is a block diagram illustrating an oblique view of a miniature-ferrite-triad switch according to one embodiment.

FIG. 5 is a block diagram illustrating an oblique view of a miniature-ferrite-triad switch 15 according to one embodiment. The miniature-ferrite-triad switch 15 is a switchable waveguide circulator 15. The miniature-ferrite-triad switch 15 includes a first ferrite element 109-1, a second ferrite element 109-2, and a third ferrite element 109-3, a first set of three waveguide arms 105(1-3), a second set of three waveguide arms 105(4-6), a seventh-waveguide arm 105-7, a first quarter-wave dielectric transformer 210-1, a second quarter-wave dielectric transformer 210-2, a first coaxial-coupling component 104-1, and a second coaxial-coupling component 104-2.

As shown in FIG. 5, the miniature-ferrite-triad switch 15 includes a first waveguide circulator 10-1 and a second waveguide circulator 10-2. The first waveguide circulator 10-1 includes the first coaxial-coupling component 104-1 is within a quarter wavelength $\lambda/4$ of the electro-magnetic field from a first quarter-wave dielectric transformer 210-1. The second waveguide circulator 10-2 includes the second coaxial-coupling component 104-2 that is positioned within a quarter wavelength $\lambda/4$ of the electro-magnetic field from a second quarter-wave dielectric transformer 210-positioned in the fourth-waveguide arm 105-4.

The first ferrite element 109-1 includes a first segment 111-1 protruding into a first-waveguide arm 105-1, a second segment 111-2 protruding into a second-waveguide arm 105-2, and a third segment 111-3 protruding into a third-waveguide arm. The first quarter-wave dielectric transformer 210-1 is attached to the end of the first segment 111-1.

The second ferrite element 109-2 has a fourth segment 111-4 protruding into a fourth-waveguide arm 105-4, a fifth segment 111-5 protruding into a fifth-waveguide arm 105-5, and a sixth segment 111-6 protruding into a sixth-waveguide arm 105-6. The second quarter-wave dielectric transformer 210-2 is attached to the end of the fourth segment 111-4. The third ferrite element 109-3 has a seventh segment 111-7 protruding into a seventh-waveguide arm 105-7, an eighth segment 111-7 protruding into the third-waveguide arm 105-3, and a ninth segment 111-8 protruding into the sixth-waveguide arm 105-6. A third quarter-wave dielectric transformer 210-3 is attached to the end of the seventh segment 111-7.

The ends of the third segment 111-3 and the eighth segment 111-8 are proximally located so the electro-magnetic field can propagate between the third segment 111-3 and the eighth segment 111-8. The ends of the sixth segment 111-6 and the ninth segment 111-9 are proximally located so the electro-magnetic field can propagate between the sixth segment 111-6 and the ninth segment 111-9.

At any given time, based on the switching state of the miniature-ferrite-triad switch 15, a signal is transmitted from the seventh-waveguide arm 105-7 to one of the first coaxial-coupling components 104-1 or the second coaxial-coupling component 104-2. In a first switching state, the signal is transmitted from the seventh-waveguide arm 105-7 to the first coaxial-coupling component 104-1. When the miniature-ferrite-triad switch 15 is configured in the first switching state, the eighth segment 111-8 protruding into the third-waveguide arm 105-3 couples the electro-magnetic field to the third segment 111-3 protruding into the third-waveguide arm 105-3.

In a second switching state, the signal is transmitted from the seventh-waveguide arm 105-7 to the second coaxial-coupling component 104-2. When the miniature-ferrite-triad switch 15 is configured in the second switching state, the ninth segment protruding into the sixth-waveguide arm couples the electro-magnetic field to the sixth segment protruding into the sixth-waveguide arm.

This switching could also be implemented in a single junction ferrite switch (e.g., using the waveguide circulators 10, 11 or 12 of FIG. 1, 3, or 4, respectively) instead of the ferrite redundancy triad switch 15.

Figure 6A:
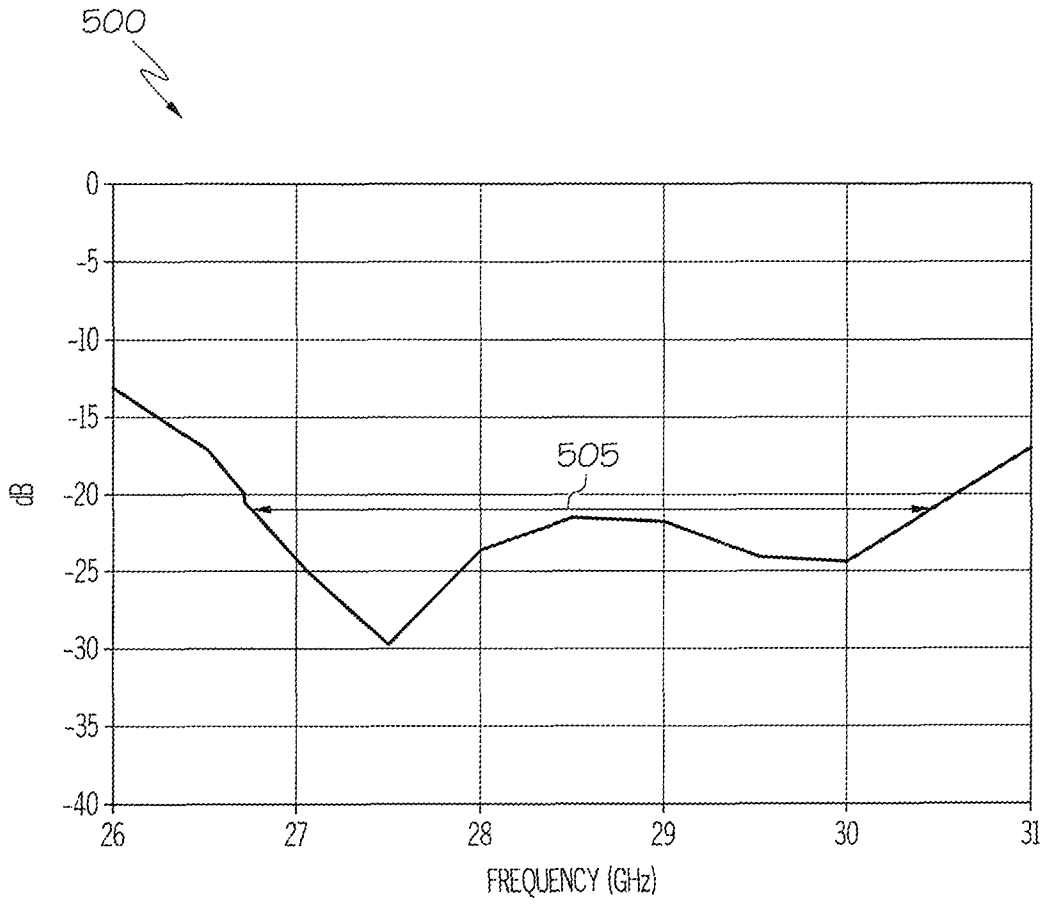
FIG. 6A is a graph of the isolation in the waveguide circulator of FIGS. 1 and 2.
Figure 6B:
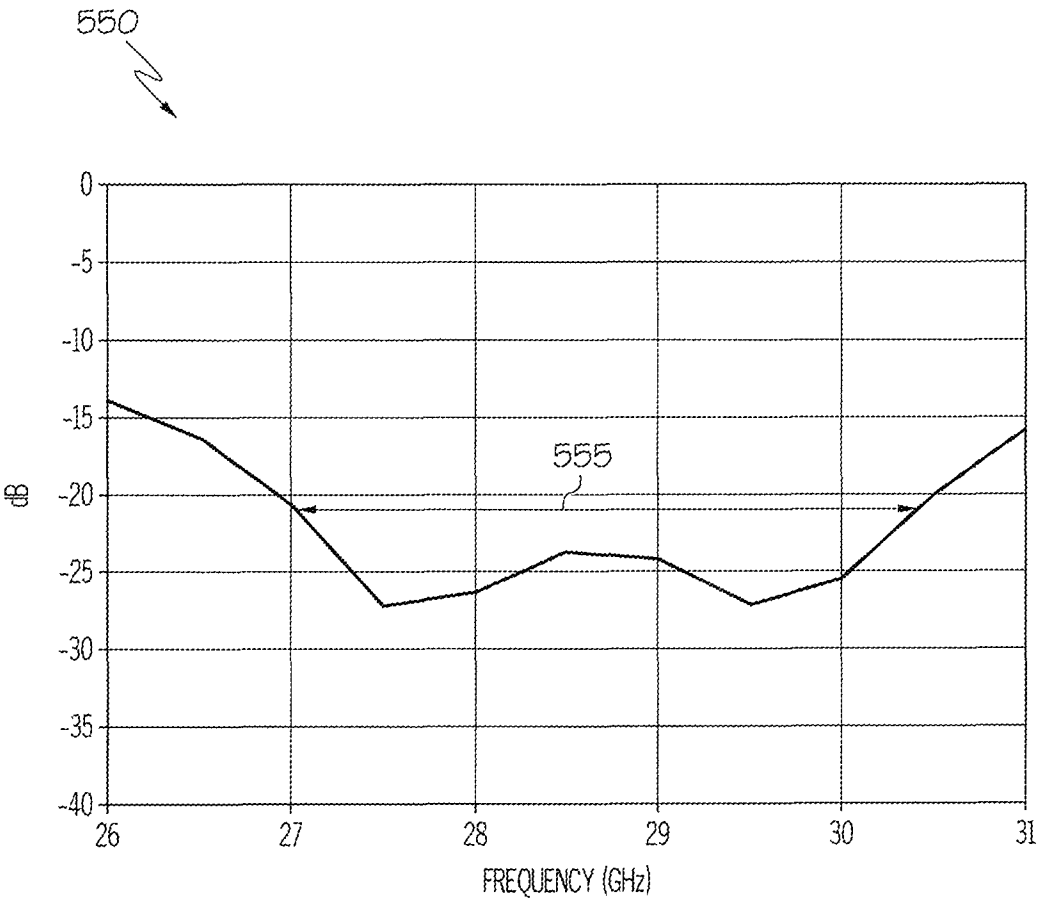
FIG. 6B is a graph of the return loss of the waveguide circulator of FIGS. 1 and 2.

FIG. 6A is a graph 500 of the isolation in the waveguide circulator 10 of FIGS. 1 and 2. As shown in graph 500, the bandwidth 505 for an isolation level of 21 dB or greater is about 4 GHz. FIG. 6B is a graph 550 of the return loss of the waveguide circulator 10 of FIGS. 1 and 2. As shown graph 550, the bandwidth 555 for a return loss of 21 dB or greater is greater than 3 GHz. Thus, the waveguide circulator 10 of FIGS. 1 and 2 provides a large bandwidth due to the improved impedance matching of the waveguide circulator 10.

Figure 11:
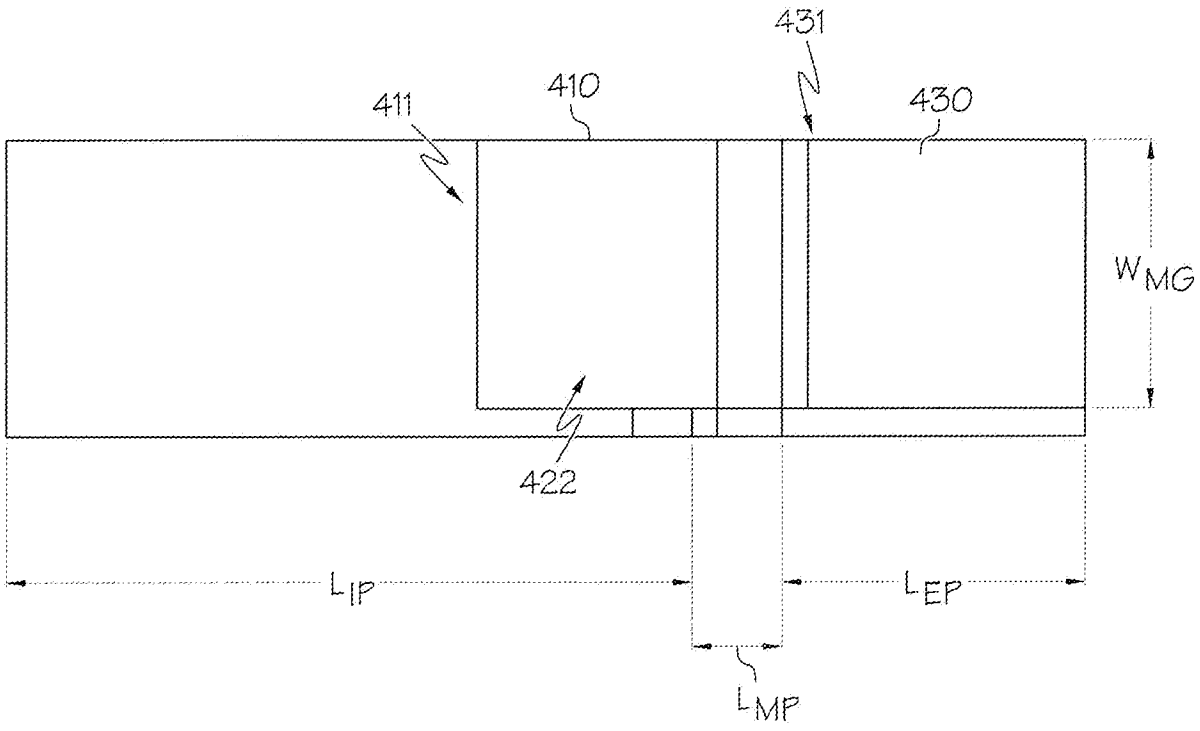
FIGS. 11-12 are block diagrams illustrating views of a first-waveguide arm in the waveguide circulator of FIGS. 7-10.
Figure 12:
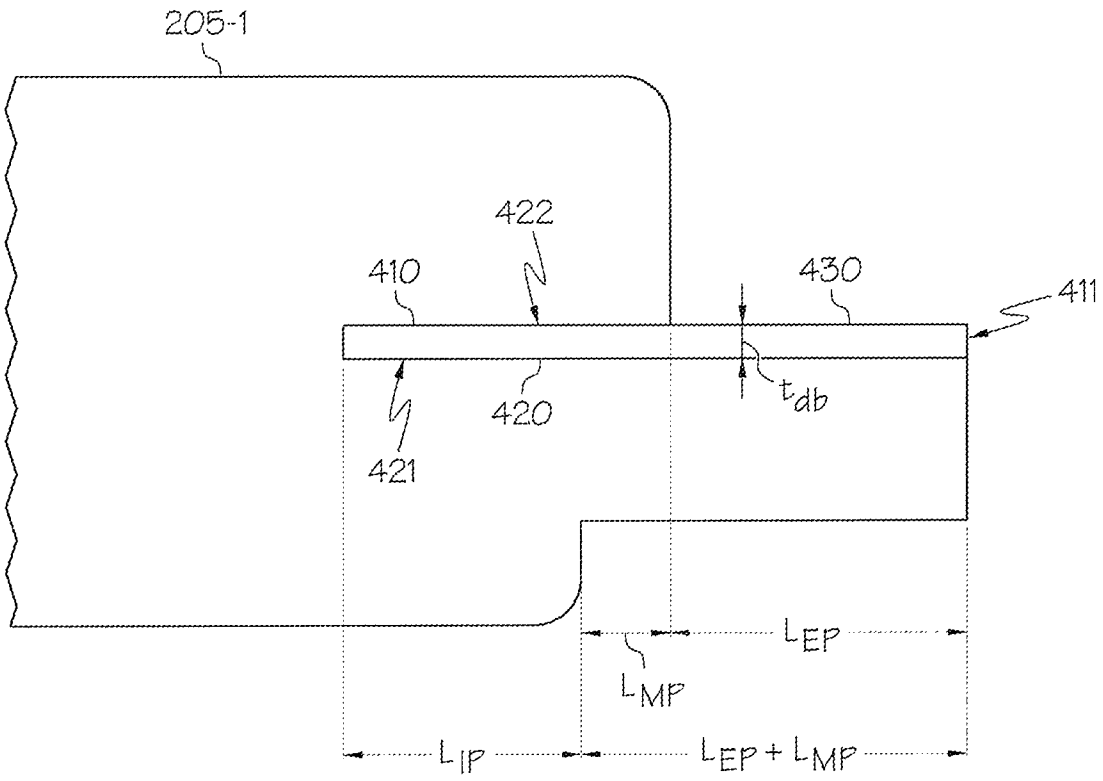

FIGS. 7-10 are block diagrams illustrating various views of a waveguide circulator 13 according to one embodiment. FIGS. 11-12 are block diagrams illustrating views of a first-waveguide arm 205-1 in the waveguide circulator 13 of FIGS. 7-10. The waveguide circulator 13 includes at least three waveguide arms 205-1, 105-2, and 105-3, a ferrite element 109 having three segments 111(1-3) protruding into the three respective waveguide arms 205-1, 105-2, and 105-3, two quarter-wave dielectric transformers 110-2 and 110-3, and an integrated-transition element 411. The integrated-transition element 411 protrudes into the first-waveguide arm 205-1. In this embodiment, the material used to fabricate ferrite element 109 is selected to have a particular saturation magnetization value, such that the impedance of ferrite element 109 matches the impedance of the two quarter-wave dielectric transformers 110-2 and 110-3, and an integrated-transition element 411.

The integrated-transition element 411 simultaneously functions as a transformer and a microstrip probe to optimize impedance matching between the waveguide arm 205-1 and the microstrip transmission line in the first-waveguide arm 205-1. A signal is transmitted to the integrated-transition element 411 via the first segment 111-1 of ferrite element 109. The microstrip trace 420 on the integrated-transition element 411 then radiates the signal into the microstrip transmission line portion of the integrated-transition element 411. The microstrip trace 420 acts like a probe (with no microstrip ground plane) close to the first segment 111-1 of the ferrite element 109. The microstrip trace 420 becomes a standard microstrip conductor once the microstrip trace 420 on the surface 421 (FIG. 10) of the integrated-transition element 411 and the microstrip-ground layer 430 on the surface 422 (FIG. 11) of the integrated-transition element 411 oppose each other. In this manner, the electro-magnetic fields transition from waveguide to microstrip all within the integrated transition element 411. At the end of the integrated-transition element 411 away from the first segment 111-1 of the ferrite element 109, the electro-magnetic fields propagate in a quasi-transverse electromagnetic (TEM) microstrip mode in the integrated-transition element 411 and do not propagate in a transverse electric (TE) waveguide mode in the waveguide arm 205-1. Since the waveguide circulator 13 can be bidirectionally configured, the integrated-transition element 411 can simultaneously function as a transformer and a microstrip probe to optimize impedance matching for electro-magnetic fields that propagate from the waveguide arm 205-1 to the microstrip trace 420 as is understandable to one skilled in the art upon reading and understanding this document.

The length $L_1$ (FIGS. 7 and 8) of the first-waveguide arm 205-1 is approximately a length $L_2$ of the two other-waveguide arms 105-2 and 105-3. The integrated-transition element 411 includes a microstrip-dielectric board 410, which is attached to an end 211-1 (FIGS. 7-9) of the first segment 111-1 of the ferrite element 109, a microstrip trace 420 on a first surface 421 of the microstrip-dielectric board 410, and a microstrip-ground layer 430 on a second surface 422 of the microstrip-dielectric board 410. The first surface 421 opposes the second surface 422.

Figure 7:
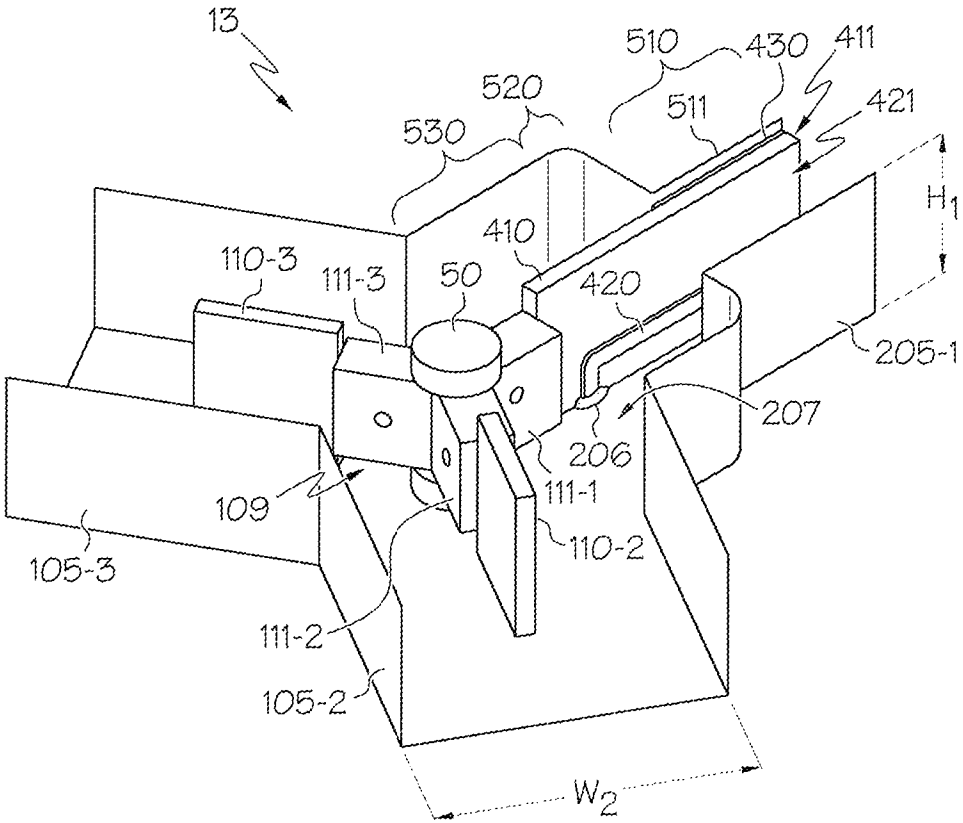
FIGS. 7-10 are block diagrams illustrating various views of a waveguide circulator according to one embodiment.
Figure 8:
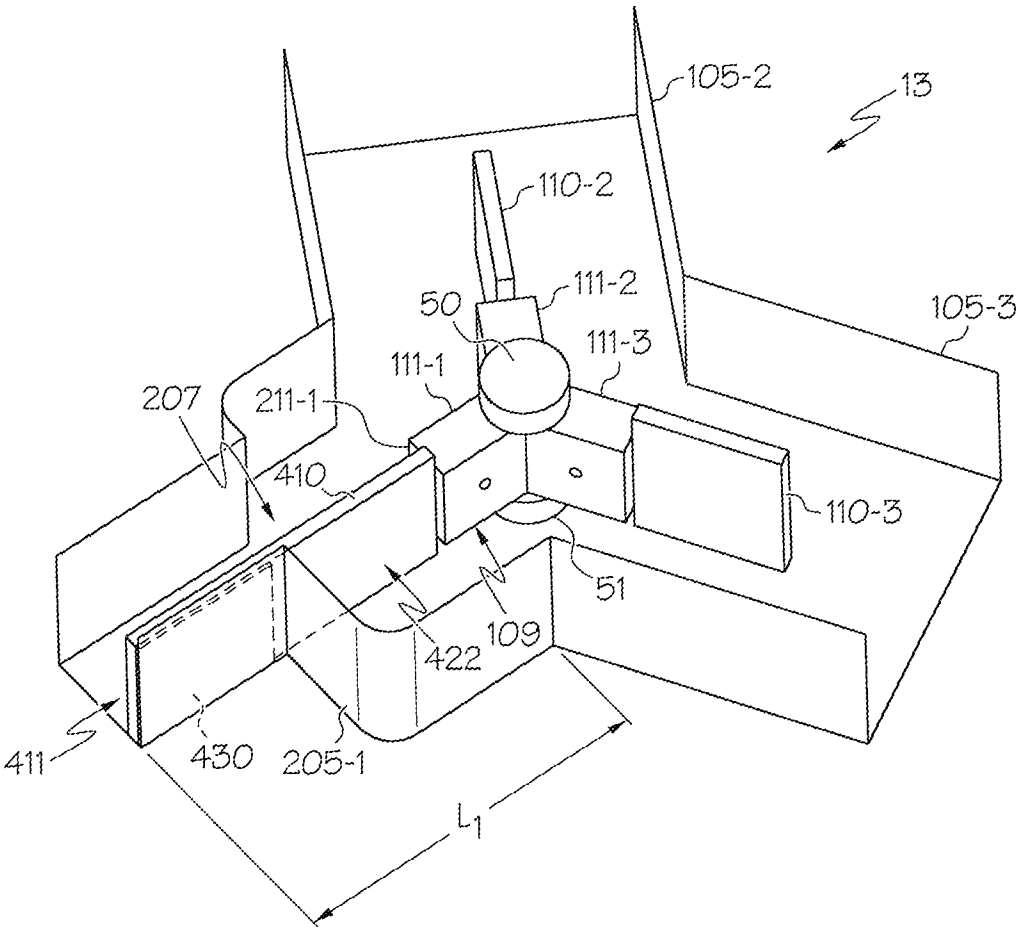
Figure 9:
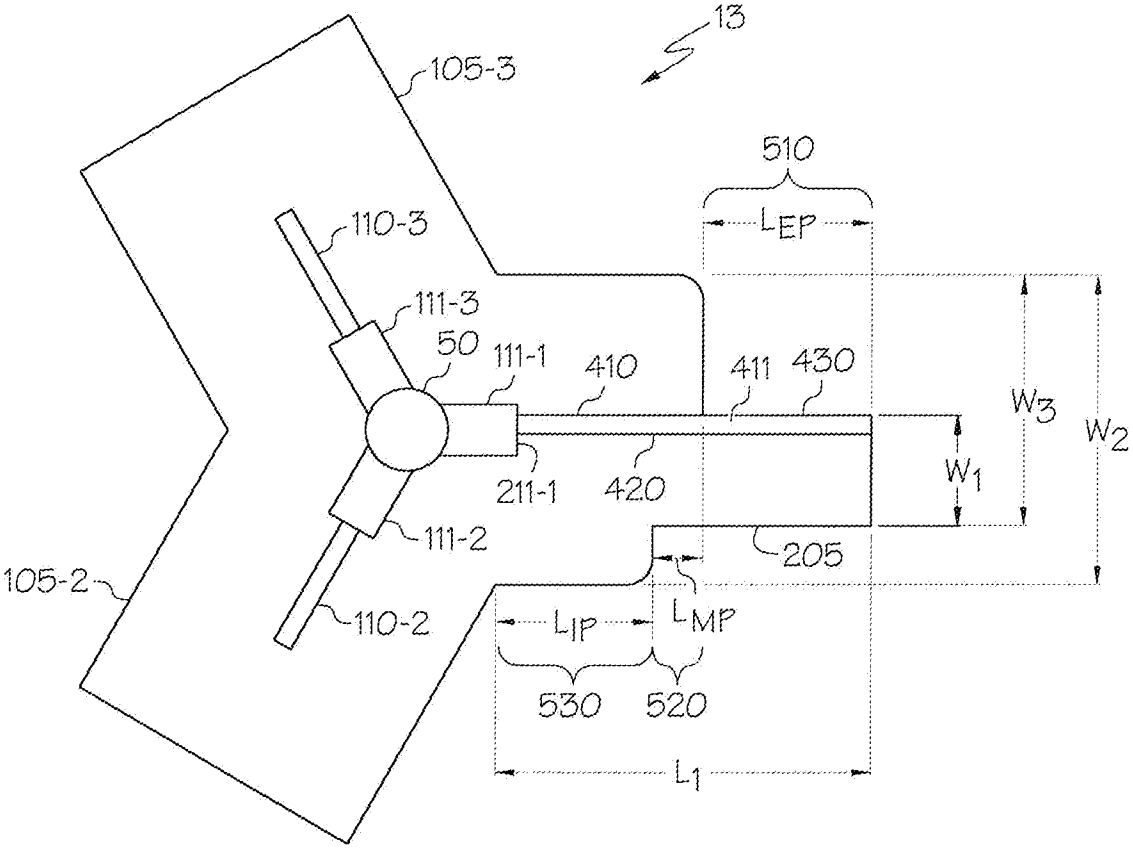
Figure 10:
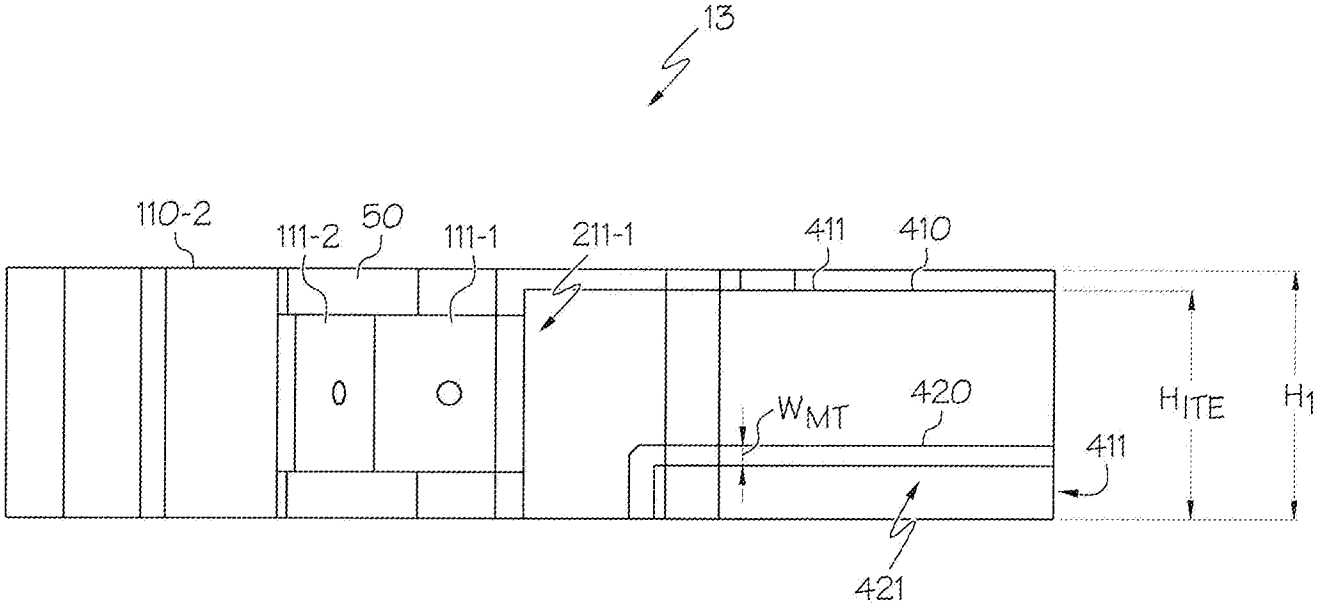

As shown in FIG. 9, the first-waveguide 205-1 has an end-portion represented generally at 510, an inner-portion represented generally at 530, and a middle-portion 520. The end-portion 510 has a height $H_1$ (FIGS. 6 and 9), a length $L_{EP}$ (FIG. 9), and a first width $W_1$. The inner-portion 530 has the height $H_1$, a length $L_{IP}$, and a second width $W_2$. The second width $W_2$ is larger than the first width $W_1$. The middle-portion 520 has the height $H_1$, a length $L_{MP}$, and a third width $W_3$. The third width $W_3$ is greater than the first width $W_1$ and less than the second width $W_2$. As shown in FIGS. 6-8, the inner-portion 530 and the middle-portion 520 include rounded corner sections. In one implementation of this embodiment, the inner-portion 530 and the middle-portion 520 have right-angle corner sections.

The microstrip-ground layer 430 contacts a sidewall 511 (FIG. 7) of the end-portion 510 of the first-waveguide arm 205-1. In one implementation of this embodiment, the microstrip-ground layer 430 is offset from the sidewall 511 of the end-portion 510 of the first-waveguide arm 205-1. As shown in FIG. 11, the microstrip-ground layer 430 starts at a starting-edge 431 of the microstrip-ground layer 430.

The impedance matching between the integrated-transition element 411 and the waveguide 205-1 is optimized based on: a position of the microstrip trace 420 on the microstrip-dielectric board 410; a thickness of the microstrip-dielectric board 410; a position of the starting-edge 431 of microstrip-ground layer 430 on the microstrip-dielectric board 410; a width $W_{MT}$ (FIG. 10) of the microstrip trace 420 on a conductor side of the microstrip-dielectric board 410; a width $W_{MG}$ (FIG. 11) of the microstrip-ground layer 430 on a ground side of the microstrip-dielectric board 410; a thickness $t_{db}$ (FIG. 12) of the microstrip-dielectric board 410; and a position of the microstrip-dielectric board 410 in the first-waveguide arm 205-1.

The orientation and the shape of the microstrip trace 420 partially define the position of the microstrip trace 420. In one implementation of this embodiment, microstrip trace 420 is electrically connected (grounded) via conductive material 206 to the waveguide floor. As shown in FIG. 7, a conductive material 206 electrically connects the microstrip trace 420 to the waveguide floor 207. The conductive material 206 grounding of the microstrip trace to the waveguide floor 207 (FIG. 7) of the first-waveguide arm 205-1 can be conductive epoxy, solder, or other conductive materials. The integrated-transition element 411 has a height $H_{ITE}$ (FIG. 10) that is less than a height $H_1$ of the first-waveguide arm 205-1. In one implementation of this embodiment, the height $H_{ITE}$ of the integrated-transition element 411 is between 90% and 95% of the height $H_1$ of the first-waveguide arm 205-1. In another implementation of this embodiment, the height $H_{ITE}$ of the integrated-transition element 411 is between 75% and 100% of the height $H_1$ of the first-waveguide arm 205-1.

The first-waveguide arm 205-1 is one of an output-waveguide arm or input-waveguide arm. In one implementation of this embodiment, the first-waveguide arm 205-1 is alternately an output-waveguide arm and an input-waveguide arm.

Figure 13:
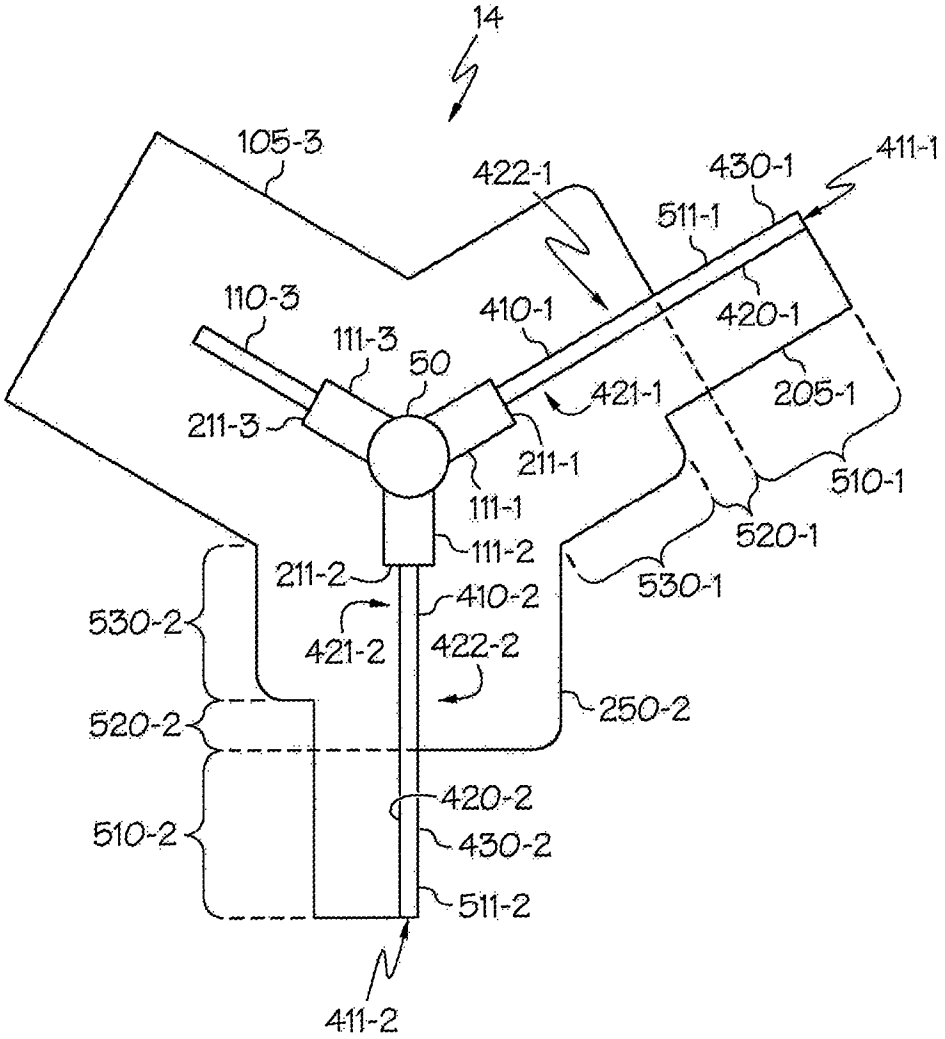
FIG. 13 is a block diagram illustrating a top view of a waveguide circulator according to one embodiment.

FIG. 13 is a block diagram illustrating a top view of a waveguide circulator 14 according to one embodiment. The waveguide circulator 14 differs from the waveguide circulator 13 of FIGS. 7-10 in that a first integrated-transition element 411-1 is attached to the end 211-1 of the first segment 111-1 and a second integrated-transition element 411-2 is attached to the end 211-2 of the second segment 111-2. The first integrated-transition element 411-1 and the second integrated-transition element 411-2 have a similar structure and function as the integrated-transition element 411 described above with reference to FIGS. 6-11. The first integrated-transition element 411-1 includes a microstrip trace 420-1 on the surface 421-1 and a microstrip-ground layer 430-1 on the surface 422-1 of the first integrated-transition element 411-1. Similarly, the second integrated-transition element 411-2 includes a microstrip trace 420-2 on the surface 421-2 and a microstrip-ground layer 430-2 on the surface 422-2 of the second integrated-transition element 411-2. The second integrated-transition element 411-2 extends into a second-waveguide arm 205-2 that is configured similarly to the first-waveguide arm 205-1. In this case, the second integrated-transition element 411-2 simultaneously functions as a transformer and a microstrip probe to optimize impedance matching in the second-waveguide arm 205-2. In one implementation of this embodiment, the first-waveguide arm 205-1 in an input waveguide while the second-waveguide arm 205-2 is an output waveguide. In another implementation of this embodiment, the first-waveguide arm 205-1 in an output waveguide while the second-waveguide arm 205-2 is an input waveguide.

Other embodiments of waveguide circulators are possible. In one implementation of this embodiment, the waveguide circulator includes at least N waveguide arms 105(1-N), a ferrite element 109 having N segments 111(1-N) protruding into the N respective waveguide arms, at most (N−1) quarter-wave dielectric transformers 110(2-N), and at least one integrated-transition element 411. The number of (N−1) quarter-wave dielectric transformers 110(2-N) and number of the at least one integrated-transition element 411 together sum to N. Thus, if an exemplary waveguide circulator includes three integrated-transition elements 411(1-3), then the waveguide circulator includes (N−3) quarter-wave dielectric transformers 110(4-N).

Figure 14:
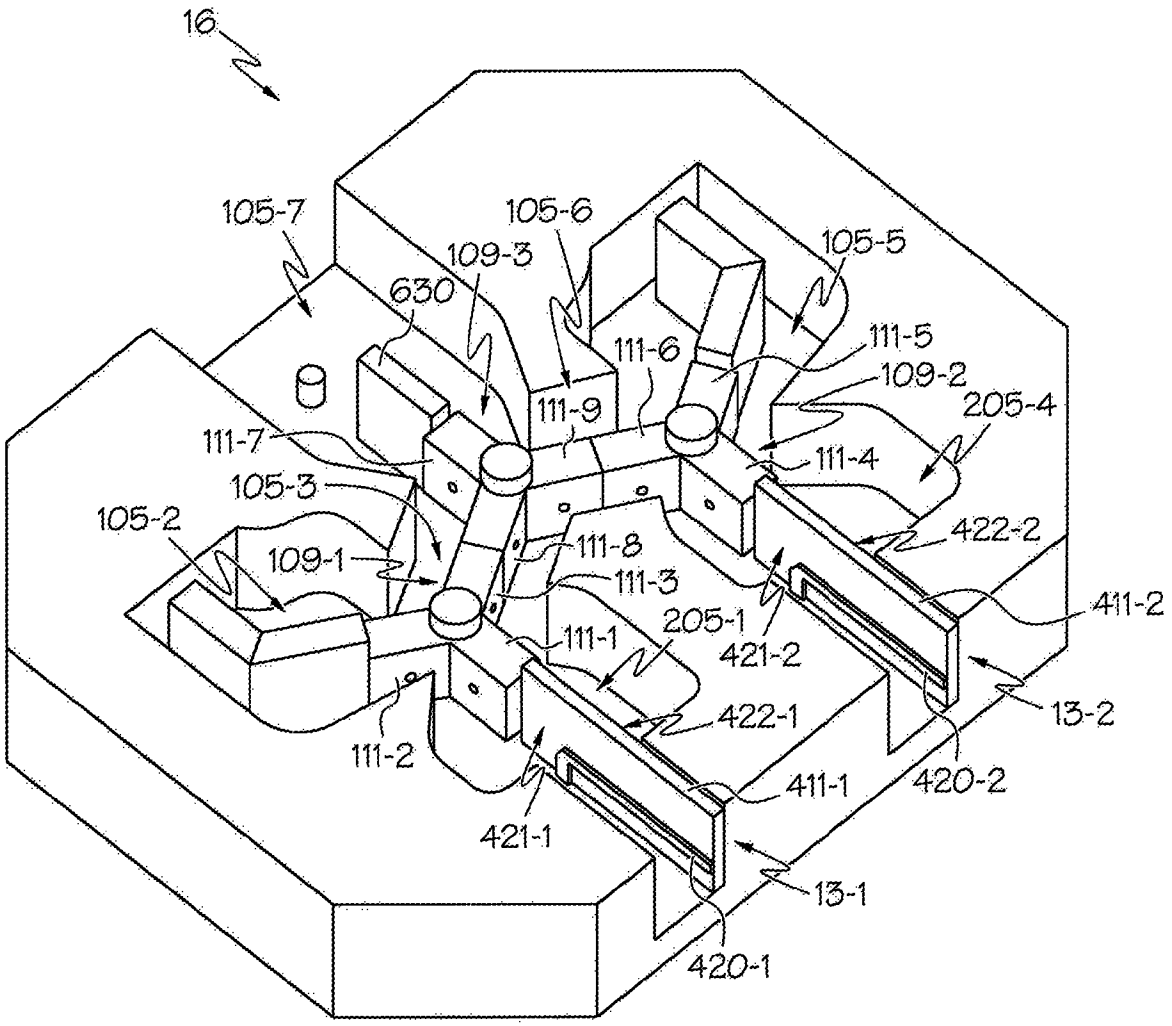
FIG. 14 is a block diagram illustrating an oblique view of a miniature ferrite triad switch according to one embodiment.

FIG. 14 is a block diagram illustrating an oblique view of a miniature ferrite triad switch 16 according to one embodiment. The miniature-ferrite-triad switch 16 is a switchable waveguide circulator. The miniature-ferrite-triad switch 16 includes a first ferrite element 109-1, a second ferrite element 109-2, and a third ferrite element 109-3, a first set of three waveguide arms including a first-waveguide arm 205-1, a second-waveguide arm 105-2, and a third-waveguide arms 105-3, a second set of three waveguide arms including a fourth-waveguide arm 205-4, a fifth-waveguide arm 105-5, and a sixth-waveguide arm 105-6, a seventh-waveguide arm 105-7, a first integrated-transition element 411-1, and a second integrated-transition element 411-2.

As shown in FIG. 14, the miniature-ferrite-triad switch 16 includes a first waveguide circulator 13-1 and a second waveguide circulator 13-2. The first waveguide circulator 13-1 includes the first integrated-transition element 411-1 positioned in the first-waveguide arm 205-1. The second waveguide circulator 13-2 includes the second quarter-wave dielectric transformer 411-2 positioned in the fourth-waveguide arm 205-4.

The first ferrite element 109-1 includes a first segment 111-1 protruding into the first-waveguide arm 205-1, a second segment 111-2 protruding into the second-waveguide arm 105-2, and a third segment 111-3 protruding into a third-waveguide arm. The first integrated-transition element 411-1 is attached to the end of the first segment 111-1.

The second ferrite element 109-2 has a fourth segment 111-4 protruding into the fourth-waveguide arm 205-4, a fifth segment 111-5 protruding into the fifth-waveguide arm 105-5, and a sixth segment 111-6 protruding into the sixth-waveguide arm 105-6. The second integrated-transition element 411-2 is attached to the end of the fourth segment 111-4. A quarter-wave dielectric transformer 110-5 is attached to the end of the fifth segment 111-5. The third ferrite element 109-3 has a seventh segment 111-7 protruding into a seventh-waveguide arm 105-7, an eighth segment 111-8 protruding into the third-waveguide arm 105-3, and a ninth segment 111-9 protruding into the sixth-waveguide arm 105-6. A quarter-wave dielectric transformer 630 is attached to the end of the seventh segment 111-7.

The ends of the third segment 111-3 and the eighth segment 111-8 are proximally located so the electro-magnetic field can propagate between the third segment 111-3 and the eighth segment 111-8. The ends of the sixth segment 111-6 and the ninth segment 111-9 are proximally located so the electro-magnetic field can propagate between the sixth segment 111-6 and the ninth segment 111-9.

At any given time, based on the switching state of the miniature-ferrite-triad switch 16, a signal is transmitted from the seventh-waveguide arm 105-7. In a first switching state, the signal is transmitted from the seventh-waveguide arm 105-7 to the first integrated-transition element 411-1 via the first ferrite element 109-1. The microstrip trace 420-1 on the first integrated-transition element 411-1 then radiates the signal into the microstrip transmission line portion of the first integrated-transition element 411-1. The microstrip trace 420-1 acts like a probe (with no ground plane) close to the first segment 111-1 of the first ferrite element 109-1. The microstrip trace 420-1 becomes a standard microstrip conductor once the microstrip trace 420-1 on the first surface 421-1 of the first integrated-transition element 411-1 and the first microstrip-ground layer (not visible in FIG. 14) on the second surface 422-1 of the first integrated-transition element 411-1 oppose each other.

In this manner, the electro-magnetic fields transition from waveguide to microstrip all within the first integrated transition element 411-1. At the end of the first integrated-transition element 411-1 away from the first segment 111-1 of the first ferrite element 109-1, the electro-magnetic fields propagate in a quasi-transverse electromagnetic (TEM) microstrip mode in the first integrated transition element 411-1 and do not propagate in a transverse electric (TE) waveguide mode in the first-waveguide arm 205-1. If a first LNA is coupled to the first-waveguide arm 205-1, the first LNA receives the signal via the first integrated-transition element 411-1 in the first-waveguide arm 205-1.

In a second switching state, the signal is transmitted from the seventh-waveguide arm 105-7 to the second integrated-transition element 411-2 via the second ferrite element 109-2. The microstrip trace 420-2 on the second integrated-transition element 411-2 then radiates the signal into the microstrip transmission line portion of the second integrated-transition element 411-2. The microstrip trace 420-2 acts like a probe (with no ground plane) close to the fourth segment 111-4 of the second ferrite element 109-2. The microstrip trace 420-2 becomes a standard microstrip conductor once the microstrip trace 420-2 on the first surface 421-2 of the second integrated-transition element 411-2 and the second microstrip-ground layer (not visible in FIG. 14) on the second surface 422-2 of the second integrated-transition element 411-2 oppose each other.

In this manner, the electro-magnetic fields transition from waveguide to microstrip all within the second integrated transition element 411-2. At the end of the second integrated-transition element 411-2 away from the fourth segment 111-4 of the second ferrite element 109-2, the electromagnetic fields propagate in a quasi-transverse electromagnetic (TEM) microstrip mode in the second integrated transition element 411-2 and do not propagate in a transverse electric (TE) waveguide mode in the fourth-waveguide arm 205-4. If a second LNA is coupled to the fourth-waveguide arm 205-4, the second LNA receives the signal via the second integrated-transition element 411-2 in the fourth-waveguide arm 205-4.

When the miniature-ferrite-triad switch 16 is configured in the first switching state, the eighth segment 111-8 protruding into the third-waveguide arm 105-3 couples the electro-magnetic field to the third segment 111-3 protruding into the third-waveguide arm 105-3. When the miniature-ferrite-triad switch 16 is configured in the second switching state, the ninth segment protruding into the sixth-waveguide arm couples the electro-magnetic field to the sixth segment protruding into the sixth-waveguide arm. This switching could also be implemented in a single junction ferrite switch (e.g., using the waveguide circulators 13 or 14 of FIG. 8 or 12, respectively) instead of the ferrite redundancy triad switch 16.

Figure 15A:
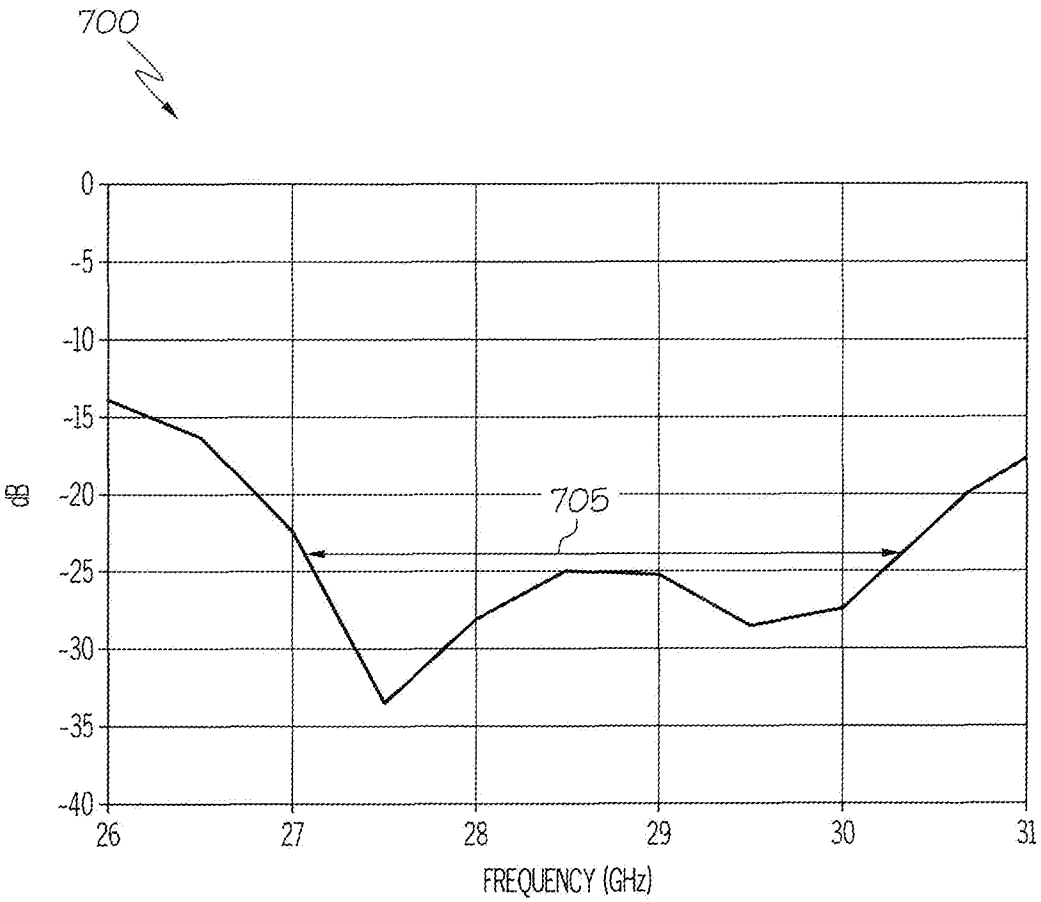
FIG. 15A is a graph of the isolation in the waveguide circulator of FIGS. 7-10.
Figure 15B:
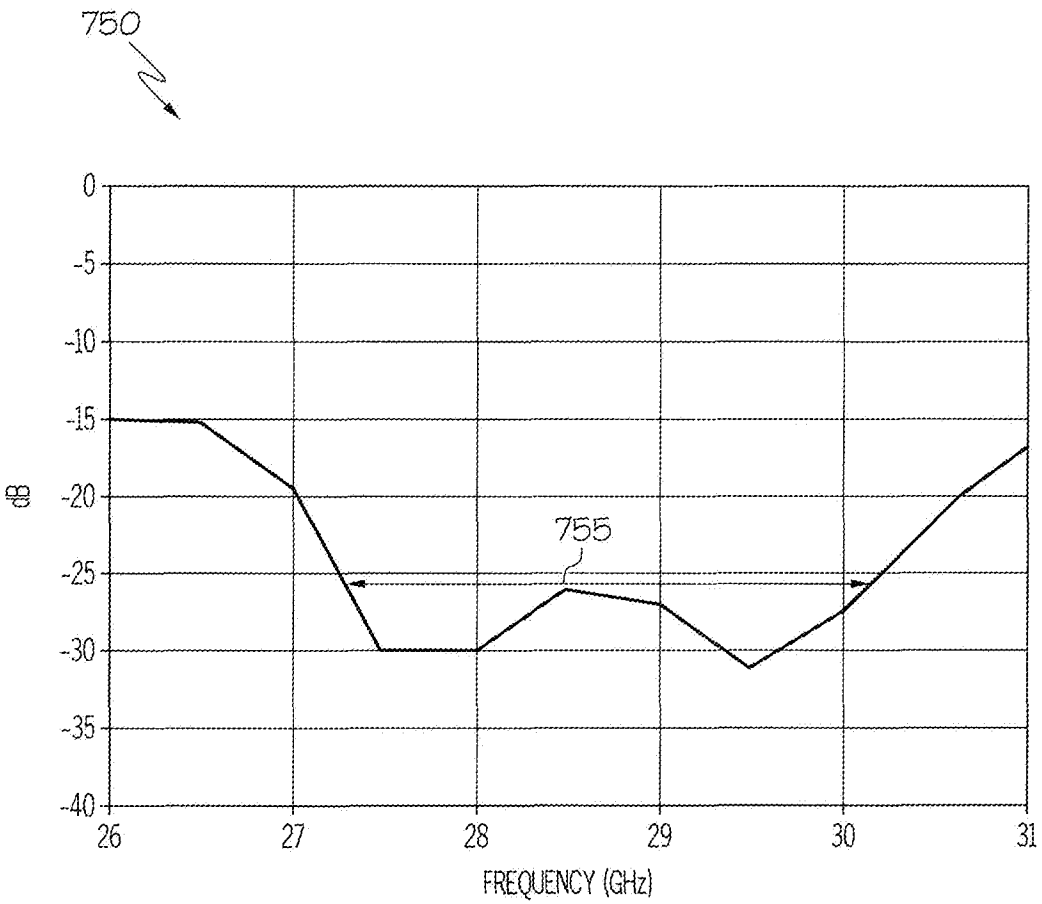
FIG. 15B is a graph of the return loss of the waveguide circulator of FIGS. 7-10.

FIG. 15A is a graph 700 of the isolation in the waveguide circulator 13 of FIGS. 7-10. As shown in graph 700, the bandwidth 705 for an isolation level of 24 dB or greater is about 3 GHz. FIG. 15B is a graph 750 of the return loss of the waveguide circulator 13 of FIGS. 7-10. As shown in graph 750, the bandwidth 755 for a return loss of 25 dB or greater is about 3 GHz. The graphs 700 and 750 are simulated for an integrated-transition element 411 with a microstrip-dielectric board 410 formed from alumina with a dielectric constant of 9.8. Thus, the waveguide circulator 13 of FIGS. 7-10 provides a large bandwidth due to the improved impedance matching of the waveguide circulator 13.

Figure 16:
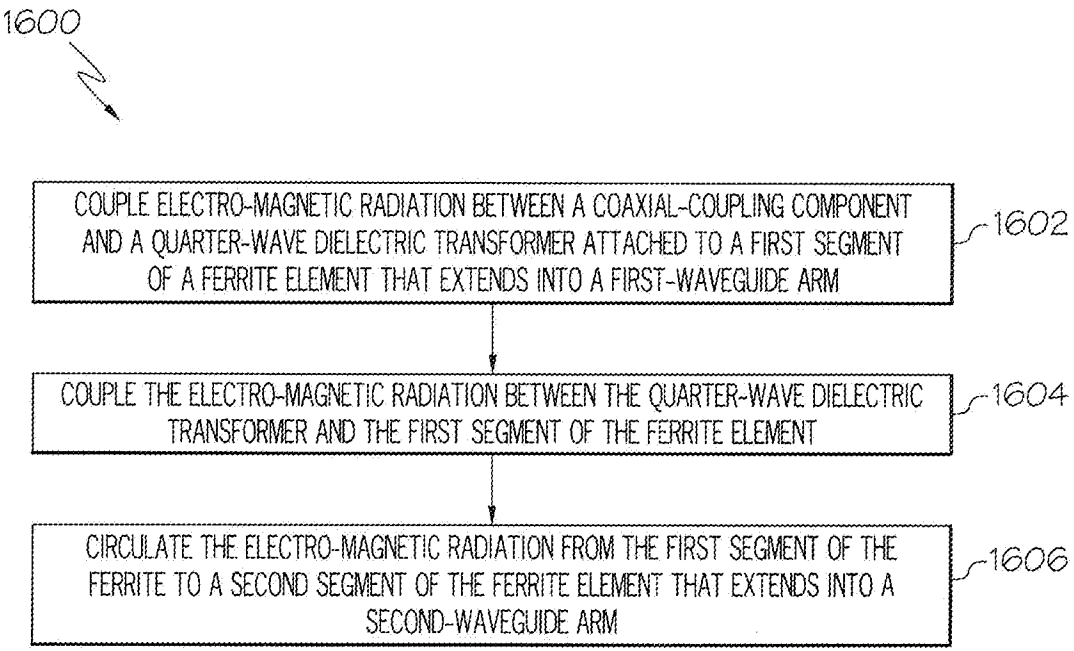
FIG. 16 is a flow diagram illustrating a method for circulating electro-magnetic radiation in a waveguide circulator according to embodiments.

FIG. 16 is a flow diagram illustrating a method 1600 for circulating electro-magnetic radiation in a waveguide circulator according to embodiments. For example, method 1600 can be implemented by any one of the waveguide circulators 10, 11 or 12 of FIG. 1, 3, or 4, respectively.

At block 1602, electro-magnetic radiation (e.g., microwave or RF signals) is coupled between a coaxial-coupling component 104 and a quarter-wave dielectric transformer 210 attached to a first segment 111-1 of a ferrite element 109 that extends into a first-waveguide arm 105-1. The coaxial-coupling component 104 is positioned within a quarter wavelength ($\lambda/4$) of the electro-magnetic radiation from the quarter-wave dielectric transformer 210.

At block 1604, the electro-magnetic radiation is coupled between the quarter-wave dielectric transformer 210 and the first segment 111-1 of the ferrite element 109.

At block 1606, the electro-magnetic radiation is circulated from the first segment 111-1 of the ferrite to a second segment 111-2 of the ferrite element 109. The second segment 111-2 of the ferrite element 109 extends into a second-waveguide arm 105-2.

Since the waveguide circulators 10, 11 or 12 can be bidirectionally configured, at any given time, the electro-magnetic radiation is either propagating from the coaxial-coupling component 104 in the first-waveguide arm 105-1 to the second segment 111-2 extending into the second-waveguide arm 105-2; or propagating from the second segment 111-2 extending into the second-waveguide arm 105-2 to the coaxial-coupling component 104 in the first-waveguide arm 105-1.

Figure 17:
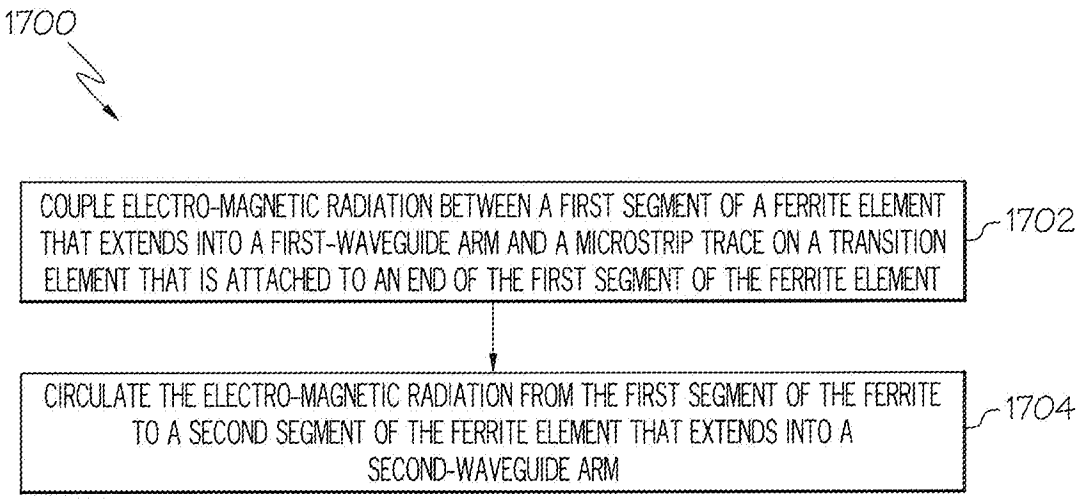
FIG. 17 is a flow diagram illustrating a method for circulating electro-magnetic radiation in a waveguide circulator according to embodiments.

FIG. 17 is a flow diagram illustrating a method 1700 for circulating electro-magnetic radiation (e.g., microwave or RF signals) in a waveguide circulator according to embodiments. For example, method 1700 can be implemented by either of the waveguide circulators 13 or 14 of FIG. 8 or 12, respectively.

At block 1702, electro-magnetic radiation is coupled between a first segment 111-1 of a ferrite element 109 that extends into a first-waveguide arm 105-1 and a microstrip trace 420 on an integrated-transition element 411. The integrated-transition element 411 is attached to an end 211-1 of the first segment 111-1 of the ferrite element 109.

At block 1704, the electro-magnetic radiation is circulated from the first segment 111-1 of the ferrite to a second segment 111-2 of the ferrite element 109. The second segment 111-2 of the ferrite element 109 extends into a second-waveguide arm 105-2.

Since the waveguide circulators 13 or 14 can be bidirectionally configured, at any given time, the electro-magnetic radiation is either propagating from the microstrip trace 420 on the integrated-transition element 411 in the first-waveguide arm 105-1 to the second segment 111-2 extending into the second-waveguide arm 105-2 via the first segment 111-1 or propagating from the second segment 111-2 extending into the second-waveguide arm 105-2 to the microstrip trace 420 on the integrated-transition element 411 in the first-waveguide arm 105-1 via the first segment 111-1.

Example Embodiments

Example 1 includes a waveguide circulator for an electromagnetic field having a wavelength comprising: N waveguide arms including a first-waveguide arm and (N−1) other-waveguide arms, where N is a positive integer; a ferrite element having N segments protruding into the N respective waveguide arms, the N segments including: a first segment protruding into the first-waveguide arm, and (N−1) other segments protruding into respective (N−1) other-waveguide arms; at most (N−1) quarter-wave dielectric transformers attached to respective ends of at most (N−1) other segments; a first quarter-wave dielectric transformer attached to an end of the first segment; and a coaxial-coupling component positioned within a quarter wavelength of the electro-magnetic field from the first quarter-wave dielectric transformer positioned in the first-waveguide arm.

Example 2 includes the waveguide circulator of Example 1, wherein the coaxial-coupling component in the first-waveguide arm contacts the first quarter-wave dielectric transformer.

Example 3 includes the waveguide circulator of any of Examples 1-2, wherein the coaxial-coupling component positioned in the first-waveguide is a first coaxial-coupling component, wherein one of the (N−1) other segments protruding into a respective one of the (N−1) other-waveguide arms is a second segment protruding into a second-waveguide arm, and wherein the quarter-wave dielectric transformer attached to the end of the second segment protruding into the second-waveguide arm is a second quarter-wave dielectric transformer, the waveguide circulator further comprising: a second coaxial-coupling component positioned within the quarter wavelength of the electro-magnetic field from the second quarter-wave dielectric transformer positioned in the second-waveguide arm.

Example 4 includes the waveguide circulator of Example 3, wherein the second coaxial-coupling component positioned contacts the second quarter-wave dielectric transformer.

Example 5 includes the waveguide circulator of any of Examples 3-4, wherein at any given time, one of: the first-waveguide arm is an output-waveguide arm and the second-waveguide arm is an input-waveguide arm; or the first-waveguide arm is the input-waveguide arm and the second-waveguide arm is the output-waveguide arm.

Example 6 includes the waveguide circulator of any of Examples 1-5, wherein the first-waveguide arm includes a waveguide backshort.

Example 7 includes the waveguide circulator of any of Examples 1-6, wherein the N waveguide arms are a first set of three waveguide arms including a first-waveguide arm, a second-waveguide arm, and a third-waveguide arm, wherein the ferrite element is a first ferrite element, wherein the (N−1) other segments protruding into the respective (N−1) other-waveguide arms are a second segment protruding into a second-waveguide arm and a third segment protruding into a third-waveguide arm, and wherein the coaxial-coupling component is a first coaxial-coupling component, the waveguide circulator further comprising: a second set of three waveguide arms including a fourth-waveguide arm, a fifth-waveguide arm, and a sixth-waveguide arm; a second ferrite element having a fourth segment protruding into the fourth-waveguide arm, a fifth segment protruding into the fifth-waveguide arm, and a sixth segment protruding into the sixth-waveguide arm; a second quarter-wave dielectric transformer attached to an end of the fourth segment; and a second coaxial-coupling component within a quarter wavelength of the electro-magnetic field from the second quarter-wave dielectric transformer positioned in the fourth-waveguide arm; and a third ferrite element having a seventh segment protruding into a seventh-waveguide arm, an eighth segment protruding into the third-waveguide arm, and a ninth segment protruding into the sixth-waveguide arm.

Example 8 includes a waveguide circulator comprising: at least N waveguide arms including a first-waveguide arm and (N−1) other-waveguide arms, where N is a positive integer, and wherein the first-waveguide has at least an end-portion having a first width and an inner-portion having a second width, the second width being larger than the first width; a ferrite element having N segments protruding into the N respective waveguide arms, the N segments including: a first segment protruding into the first-waveguide arm, and (N−1) other segments protruding into the respective (N−1) other-waveguide arms; at most (N−1) quarter-wave dielectric transformers attached to respective ends of the at most (N−1) other segments of the ferrite element; at least one integrated-transition element attached to a respective at least one end of at least the first segment and extending into the respective at least one first-waveguide arm, the at least one integrated-transition element including: a microstrip-dielectric board attached to an end of the first segment of the ferrite element; a microstrip trace on a first surface of the microstrip-dielectric board; and a microstrip-ground layer on a second surface of the microstrip-dielectric board, the first surface opposing the second surface, wherein the integrated-transition element simultaneously functions as a transformer and a microstrip probe to optimize impedance matching in the first-waveguide arm.

Example 9 includes the waveguide circulator of Example 8, wherein the impedance matching is optimized based on: a position of the microstrip trace on the microstrip-dielectric board; a thickness of the microstrip-dielectric board; a position of the microstrip-ground layer on the microstrip-dielectric board; a width of the microstrip trace on a conductor side of the microstrip-dielectric board; a width of the microstrip-ground layer on a ground side of the microstrip-dielectric board; a thickness of the microstrip-dielectric board; and a position of the microstrip-dielectric board in the first-waveguide arm.

Example 10 includes the waveguide circulator of any of Examples 8-9, wherein the microstrip-ground layer contacts a sidewall of the end-portion of the first-waveguide arm Example 11 includes the waveguide circulator of any of Examples 8-10, wherein the integrated-transition element has a height that is less than a height of the first-waveguide arm.

Example 12 includes the waveguide circulator of any of Examples 8-11, wherein the first-waveguide has a middle-portion having a third width, the third width being greater than the first width and less than the second width.

Example 13 includes the waveguide circulator of any of Examples 8-12, wherein the microstrip trace is electrically connected to a waveguide floor of the first-waveguide arm.

Example 14 includes the waveguide circulator of any of Examples 8-13, wherein the at most (N−1) quarter-wave dielectric transformers attached to the respective ends of the at most (N−1) other segments of the ferrite element comprises: (N−2) quarter-wave dielectric transformers attached to respective ends of (N−2) of the other segments of the ferrite element, wherein the at least one integrated-transition element is a first integrated-transition element, and wherein the at least one integrated-transition element attached to the respective at least one end of at least the first segment and extending into the first-waveguide arm further comprises: a second integrated-transition element attached to a respective second end of a second segment and extending into a second-waveguide arm.

Example 15 includes the waveguide circulator of any of Examples 8-14, wherein the N waveguide arms are a first set of three waveguide arms including a first-waveguide arm, a second-waveguide arm, and a third-waveguide arm, wherein the ferrite element is a first ferrite element, wherein the (N−1) other segments protruding into the respective (N−1) other-waveguide arms are a second segment protruding into a second-waveguide arm and a third segment protruding into a third-waveguide arm, and wherein the at least one integrated-transition element is a first integrated-transition element, the waveguide circulator further comprising: a second set of three waveguide arms including a fourth-waveguide arm, a fifth-waveguide arm, and a sixth-waveguide arm; a second ferrite element having a fourth segment protruding into the fourth-waveguide arm, a fifth segment protruding into the fifth-waveguide arm, and a sixth segment protruding into the sixth-waveguide arm; a second integrated-transition element attached to an end of the fourth segment, wherein the second integrated-transition element simultaneously functions as a transformer and a microstrip probe to optimize impedance matching in the fourth-waveguide arm; and a third ferrite element having a seventh segment protruding into a seventh-waveguide arm, an eighth segment protruding into the third-waveguide arm, and a ninth segment protruding into the sixth-waveguide arm.

Example 16 includes the waveguide circulator of any of Examples 8-15, wherein a length of the first-waveguide arm is approximately a length of the (N−1) other-waveguide arms.

Example 17 includes a method for circulating electro-magnetic radiation in a waveguide circulator, the method comprising: coupling electro-magnetic radiation between a coaxial-coupling component and a quarter-wave dielectric transformer attached to a first segment of a ferrite element that extends into a first-waveguide arm, the coaxial-coupling component positioned within a quarter wavelength of the electro-magnetic radiation from the quarter-wave dielectric transformer; coupling the electro-magnetic radiation between the quarter-wave dielectric transformer and the first segment of the ferrite element; and circulating the electro-magnetic radiation from the first segment of the ferrite to a second segment of the ferrite element, wherein the second segment of the ferrite element extends into a second-waveguide arm.

Example 18 includes the method of Example 17, wherein, at any given time, the electro-magnetic radiation is one of: propagating from the coaxial-coupling component in the first-waveguide arm to the second segment extending into the second-waveguide arm; or propagating from the second segment extending into the second-waveguide arm to the coaxial-coupling component in the first-waveguide arm.

Example 19 includes a method for circulating electro-magnetic radiation in a waveguide circulator, the method comprising: coupling electro-magnetic radiation between: a first segment of a ferrite element that extends into a first-waveguide arm; and a microstrip trace on an integrated-transition element that is attached to an end of the first segment of the ferrite element; and circulating the electro-magnetic radiation from the first segment of the ferrite to a second segment of the ferrite element, wherein the second segment of the ferrite element extends into a second-waveguide arm.

Example 20 includes the method of Example 19, wherein, at any given time, the electro-magnetic radiation is one of: propagating from the microstrip trace on the integrated-transition element in the first-waveguide arm to the second segment extending into the second-waveguide arm via the first segment; or propagating from the second segment extending into the second-waveguide arm to the microstrip trace on the integrated-transition element in the first-waveguide arm via the first segment.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

What is claimed is:

1. A waveguide circulator comprising:

at least N waveguide arms including a first-waveguide arm and (N−1) other-waveguide arms, where N is a positive integer, and wherein the first-waveguide has at least an end-portion having a first width and an inner-portion having a second width, the second width being larger than the first width;

a ferrite element having N segments protruding into the N respective waveguide arms, the N segments including: a first segment protruding into the first-waveguide arm, and (N−1) other segments protruding into the respective (N−1) other-waveguide arms;

at most (N−1) quarter-wave dielectric transformers attached to respective ends of the at most (N−1) other segments of the ferrite element;

at least one integrated-transition element attached to a respective at least one end of at least the first segment and extending into the respective at least one first-waveguide arm, the at least one integrated-transition element including:

a microstrip-dielectric board attached to an end of the first segment of the ferrite element;

a microstrip trace on a first surface of the microstrip-dielectric board; and a microstrip-ground layer on a second surface of the microstrip-dielectric board, the first surface opposing the second surface, wherein the integrated-transition element simultaneously functions as a transformer and a microstrip probe to optimize impedance matching in the first-waveguide arm.

2. The waveguide circulator of claim 1, wherein the impedance matching is optimized based on: a position of the microstrip trace on the microstrip-dielectric board; a thickness of the microstrip-dielectric board; a position of the microstrip-ground layer on the microstrip-dielectric board; a width of the microstrip trace on a conductor side of the microstrip-dielectric board; a width of the microstrip-ground layer on a ground side of the microstrip-dielectric board; a thickness of the microstrip-dielectric board; and a position of the microstrip-dielectric board in the first-waveguide arm.

3. The waveguide circulator of claim 1, wherein the microstrip-ground layer contacts a sidewall of the end-portion of the first-waveguide arm.

4. The waveguide circulator of claim 1, wherein the integrated-transition element has a height that is less than a height of the first-waveguide arm.

5. The waveguide circulator of claim 1, wherein the first-waveguide has a middle-portion having a third width, the third width being greater than the first width and less than the second width.

6. The waveguide circulator of claim 1, wherein the microstrip trace is electrically connected to a waveguide floor of the first-waveguide arm.

7. The waveguide circulator of claim 1, wherein the at most (N−1) quarter-wave dielectric transformers attached to the respective ends of the at most (N−1) other segments of the ferrite element comprises:

(N−2) quarter-wave dielectric transformers attached to respective ends of (N−2) of the other segments of the ferrite element, wherein the at least one integrated-transition element is a first integrated-transition element, and wherein the at least one integrated-transition element attached to the respective at least one end of at least the first segment and extending into the first-waveguide arm further comprises:

a second integrated-transition element attached to a respective second end of a second segment and extending into a second-waveguide arm.

8. The waveguide circulator of claim 1, wherein the N waveguide arms are a first set of three waveguide arms including a first-waveguide arm, a second-waveguide arm, and a third-waveguide arm, wherein the ferrite element is a first ferrite element, wherein the (N−1) other segments protruding into the respective (N−1) other-waveguide arms are a second segment protruding into a second-waveguide arm and a third segment protruding into a third-waveguide arm, and wherein the at least one integrated-transition element is a first integrated-transition element, the waveguide circulator further comprising:

a second set of three waveguide arms including a fourth-waveguide arm, a fifth-waveguide arm, and a sixth-waveguide arm;

a second ferrite element having a fourth segment protruding into the fourth-waveguide arm, a fifth segment protruding into the fifth-waveguide arm, and a sixth segment protruding into the sixth-waveguide arm;

a second integrated-transition element attached to an end of the fourth segment, wherein the second integrated-transition element simultaneously functions as a transformer and a microstrip probe to optimize impedance matching in the fourth-waveguide arm; and a third ferrite element having a seventh segment protruding into a seventh-waveguide arm, an eighth segment protruding into the third-waveguide arm, and a ninth segment protruding into the sixth-waveguide arm.

9. The waveguide circulator of claim 1, wherein a length of the first-waveguide arm is approximately a length of the (N−1) other-waveguide arms.

10. A method for circulating electro-magnetic radiation in a waveguide circulator, the method comprising:

coupling electro-magnetic radiation between:

a first segment of a ferrite element that extends into a first-waveguide arm; and a microstrip trace on an integrated-transition element that is attached to an end of the first segment of the ferrite element; and circulating the electro-magnetic radiation from the first segment of the ferrite to a second segment of the ferrite element, wherein the second segment of the ferrite element extends into a second-waveguide arm.

11. The method of claim 10, wherein, at any given time, the electro-magnetic radiation is one of:

propagating from the microstrip trace on the integrated-transition element in the first-waveguide arm to the second segment extending into the second-waveguide arm via the first segment; or propagating from the second segment extending into the second-waveguide arm to the microstrip trace on the integrated-transition element in the first-waveguide arm via the first segment.

* * * * *